US007367643B2

(12) United States Patent
Furuichi et al.

(10) Patent No.: US 7,367,643 B2
(45) Date of Patent: May 6, 2008

(54) INKJET PRINTING APPARATUS, INKJET PRINTING METHOD AND INKJET PRINTING SYSTEM

(75) Inventors: Tomomi Furuichi, Yokohama (JP); Daigoro Kanematsu, Yokohama (JP); Mitsutoshi Nagamura, Tokyo (JP); Takao Ogata, Tokyo (JP); Kazuo Suzuki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 41 days.

(21) Appl. No.: 11/448,785

(22) Filed: Jun. 8, 2006

(65) Prior Publication Data

US 2006/0279596 A1 Dec. 14, 2006

(30) Foreign Application Priority Data

Jun. 10, 2005 (JP) ..... 2005-171527

(51) Int. Cl.
*B41J 2/205* (2006.01)

(52) U.S. Cl. ..... 347/15; 347/104; 347/16; 347/19

(58) Field of Classification Search ..... 347/14, 347/15, 19, 16, 43, 101, 105; 271/3.15, 3.17
See application file for complete search history.

(56) References Cited

U.S. PATENT DOCUMENTS 6,386,669 B1 * 5/2002 Scofield et al. ..... 347/14
6,561,643 B1 * 5/2003 Walker et al. ..... 347/105

FOREIGN PATENT DOCUMENTS

| | | |
|---|---|---|
| JP | 7-205416 | 8/1995 |
| JP | 8-112893 | 5/1996 |
| JP | 11-309847 | 11/1999 |
| JP | 2002-307671 | 10/2002 |
| JP | 2002-337319 | 11/2002 |

* cited by examiner

*Primary Examiner*—Lamson Nguyen
(74) *Attorney, Agent, or Firm*—Fitzpatrick, Cella, Harper & Scinto

(57) ABSTRACT

For a serial inkjet printing apparatus that performs printing by employing ink having different properties, the occurrence of smear is prevented without decreasing the printing speed more than necessary. A high duty area, i.e., a unit area for which a large amount of ink is applied, is detected in a preceding printing medium. Then, while taking into account the scanning direction (ink application order) in which the detected high duty area has been printed, the period until the following printing medium is permitted to contact the high duty area is determined. Then, during printing of the following printing medium, the printing operation is delayed, so that, within the determined period of time, the following printing medium does not contact the high duty area of the preceding printing medium.

21 Claims, 18 Drawing Sheets

INKJET PRINTING APPARATUS, INKJET PRINTING METHOD AND INKJET PRINTING SYSTEM

BACKGROUND OF THE INVENTION

1. Field of the Invention

The present invention relates to an inkjet printing apparatus, an inkjet printing method and an inkjet printing system. Particularly, the present invention relates to an inkjet printing apparatus that performs printing by reciprocally scanning a printing medium using printing heads that discharge inks of a plurality of different types, and an inkjet printing method and an inkjet printing system.

2. Description of the Related Arts

The serial type inkjet printing apparatuses produced today are widely accepted and employed by the general public, primarily because they are compact and are relatively low priced, a result of their comparatively inexpensive designs and construction. These serial type inkjet printing apparatuses are designed to sequentially form images on a printing medium by alternately conveying the printing medium and scanning it with a printing head.

FIG. 2 is a schematic perspective view provided for explaining the arrangement of a serial type inkjet printing apparatus. Reference numberal 22 is a collective designation for six color printing heads, 22K, 22LC, 22C, 22LM, 22M and 22Y, for respectively discharging ink in the colors black (K), light cyan (LC), cyan (C), light magenta (LM), magenta (M) and yellow (Y). As shown in FIG. 2, the six color printing heads 22 are arranged in the main scanning direction (a direction indicated by an arrow B).

Upon receiving a printing start instruction, the printing heads 22, positioned as shown in FIG. 2 (at a home position), move across (scan) a printing medium 1 in the direction indicated by the arrow B (in the forward scanning direction), while simultaneously printing, as shown in FIG. 13, a belt-like image area (a band) having a width corresponding to the array range of the discharge ports in the printing heads 22. While scanning in the forward scanning direction (forward scanning) is being performed, ink is deposited on the printing medium 1 in the order black, light cyan, cyan, light magenta, magenta and yellow. Then, when the printing of one scan (one band) has been completed, to prepare for the printing of another band, a conveying roller 3 is rotated to convey the printing medium 1 a predetermined distance in the direction indicated by an arrow A in FIG. 1B. This time the printing head unit 2 deposits ink while moving back toward the home position (in the reverse scanning direction indicated by the arrow B) and prints another band. During the reverse scanning, the order in which ink is deposited on the printing medium 1 is the reverse of that in which it is deposited during the forward scanning, i.e., in the order yellow, magenta, light magenta, cyan, light cyan and black. Then, during a period following the completion of the most recent scanning and before the next scanning is started, the conveying of the printing medium 1 is performed by the rotation of the conveying roller 3. When the above described operation for the scanning of a band and the conveying of a printing medium a predetermined distance is repeatedly performed, a desired image can be formed on the printing medium 1.

Recently, as one means for improving the work efficiency of printer users, there have been requests for further increases in printing speeds. However, since most inkjet printing apparatuses employ water-based liquid inks, a specific fixing period is required to permit ink deposited on a printing medium to dry. This fixing period is required because when the ink in a printing area is not completely dry and it is overlapped by another printing medium, the printing area is smudged and so-called smearing occurs. Therefore, when seeking to increase printing speeds, the resolution of the smearing problem is an important problem.

Several solutions for reducing smearing have been proposed (Japanese Patent Laid-Open Publications No. 07-205416, No. 11-309847 No. 2002-337319 and No. 08-112893).

In Japanese Patent Laid-Open Publication No. 07-205416, disclosed is a method whereby a high density printing area on the most recently printed page is detected, and a period during which a subsequent page is to be kept from contacting this printing area is determined. Then, the printing of the following page is delayed until the fixing of the printing area on the preceding page has been completed, so as to prevent the following page from contacting the printing area during the determined period of time. According to this method, if the fixing of the high density printing area has been completed, the printing of the following page that will contact it is not delayed. On the other hand, if the fixing of the high density printing area has not been completed, the printing of the following page is delayed.

In Japanese Patent Laid-Open Publication No. 11-309847, disclosed is a technique whereby, in addition to the configuration described in Japanese Patent Laid-Open Publication No. 07-205416, the area of the following page for which printing is to be delayed is changed in accordance with the printing ratio for the following page.

In Japanese Patent Laid-Open Publication No. 2002-337319, disclosed is a technique whereby, in addition to the configuration described in Japanese Patent Laid-Open Publication No. 07-205416, the timing for the delay in the printing of the following page is changed in accordance with the sheet size of the following page.

In Japanese Patent Laid-Open Publication No. 08-112893, disclosed is a method for setting a specified period in accordance with the type of printing medium. Then, as a succeeding printing medium is being conveyed within the specified period, either the printing operation or the conveying of the printing medium is halted, so that the succeeding printing medium, which is yet to be discharged. is prevented from contacting the previously discharged printing medium.

When one of these methods is employed, an image can be printed for which the possibility of smearing is reduced, while a major control mechanism is not especially required for the printing apparatus and the printing speed is not reduced more than is actually necessary.

Recently, in order to improve both the quality of black characters and the quality of a color photographic image, many inkjet printing apparatuses have been provided in which black ink and color inks having different properties in permeation and diffusion can be mounted. For example, a printing apparatus is provided wherein a pigment is employed as black ink and dyes are employed as other color inks, and an inkjet printing apparatus is provided that employs low permeant black ink and high permeant ink in other colors. Furthermore, in order to improve the quality of a printed image, an inkjet printing apparatus is also provided wherein a liquid that reacts with ink is mounted, or wherein a plurality of inks that react with each other are mounted (see Japanese Patent Laid-Open Publication No. 2002-307671). In this case, ambiguity (e.g., feathering) at the edges of black characters and color bleeding are prevented, as is excessive permeation of printing medium by ink. As a result, a high quality, high density images can be obtained.

When the above described different types of ink (or liquids) are mounted in a serial inkjet printing apparatus, as shown in FIG. 2, and bidirectional printing is performed, the order in which ink is provided differs for forward scanning and for reverse scanning. And in such a case, according to a study performed by the present inventors, it was found that there is a difference in the fixing times required for an image printed during forward scanning and an image printed during reverse scanning.

The methods described in the above patent documents, however, do not take into account the resultant difference in fixing times when the order in which ink is provided differs. Therefore, when the methods described in these patent documents are applied, periods that is longer than necessary are required to resolve smearing. That is, for an image printed using both forward scanning and reverse scanning, the printing process must be adjusted to prevent smearing in the portions of the image that require longer fixing times. Therefore, in the interest of providing shorter printing times, further improvements are required.

SUMMARY OF THE INVENTION

Accordingly, the present invention is conceived as a response to the above-described disadvantages of the conventional art.

For example, an apparatus, method and system according to the present invention are capable of preventing smearing without excessively reducing printing speed.

The first aspect of the present invention is an inkjet printing apparatus, which prints a printing medium by reciprocally moving, across the printing medium, printing heads that at least apply a first ink and a second ink of a type different from that of the first ink, comprising: print controller which performs printing so that a unit area to which the first ink and the second ink are applied in this order and a unit area to which the second ink and the first ink are applied in this order are both present on the printing medium, wherein, based on an amount of ink applied and an ink application order for unit areas of a preceding printing medium, the print controller delays printing during the printing of a following printing medium.

The second aspect of the present invention is an inkjet printing apparatus, which prints a printing medium by reciprocally moving, across the printing medium, printing heads that apply at least first ink and second ink having a higher permeating speed than the first ink, comprising: print controller which performs printing so that a unit area to which the first ink and the second ink are applied in this order, and a unit area to which the second ink and the first ink are applied in this order are both present on the printing medium, wherein, based on an applied amount of the first ink and an order of application of the first ink and the second ink relative to unit areas of a preceding printing medium, the print controller delays printing during the printing operation of a following printing medium.

The third aspect of the present invention is an inkjet printing apparatus, which prints a printing medium by reciprocally moving, across the printing medium, printing heads that apply at least first ink and second ink having a higher permeating speed than the first ink, comprising: a print controller which performs printing so that a unit area to which the first ink and the second ink are applied in this order, and a unit area to which the second ink and the first ink are applied in this order are both present on the printing medium, wherein, based on applied amounts of the first ink and the second ink and an order of application of the first ink and the second ink relative to unit areas of a preceding printing medium, the print controller delays printing during the printing operation of a following printing medium.

The forth aspect of the present invention is an inkjet printing apparatus, which prints a printing medium by reciprocally moving printing heads that apply a plurality of ink types, comprising: detection means for calculating an amount of applied ink for each of a plurality of unit areas that are obtained by dividing a preceding printing medium that is printed first, and for detecting a unit area for which the amount of applied ink is beyond a predetermined amount; determination means for, based on a scanning direction in which the detected area is to be printed, determining a period of time until a following printing medium, which is to be printed next, is permitted to contact the detected unit area; and delay control means for delaying printing while the following printing medium is currently printed, so that, within the determined period, the following printing medium does not contact the detected unit area of the preceding printing medium.

The fifth aspect of the present invention is an inkjet printing method, for printing a printing medium by reciprocally moving, across the printing medium, printing heads that at least apply a first ink and a second ink of a type different from that of the first ink, comprising: performing printing so that a unit area to which the first ink and the second ink are applied in this order and a unit area to which the second ink and the first ink are applied in this order are both present on the printingmedium, whereby, based on an amount of ink applied and an ink application order for unit areas of a preceding printing medium, the printing is delayed during the printing of a following printing medium.

The sixth aspect of the present invention is an inkjet printing system comprising an inkjet printing apparatus and data supply apparatus connected to the inkjet printing apparatus ,wherein the inkjet printing apparatus prints a printing medium by reciprocally moving, across the printing medium, printing heads that at least apply a first ink and a second ink of a type different from that of the first ink, comprising: print controller which performs printing so that a unit area to which the first ink and the second ink are applied in this order and a unit area to which the second ink and the first ink are applied in this order are both present on the printing medium, wherein, based on an amount of ink applied and an ink application order for unit areas of a preceding printing medium, the print controller delays printing during the printing of a following printing medium.

Other features and advantages of the present invention will become more apparent from the following description of embodiments thereof taken in conjunction with the accompanying drawings.

DETAILED DESCRIPTION OF THE PREFERRED EMBODIMENTS

The preferred embodiments of the present invention will now be described in detail while referring to the accompanying drawings.

In this specification, "sprinting" represents not only the forming of meaningful information, such as characters or figures, but also the normal forming of images, marks or patterns on a printing medium, regardless of whether or not they have meaning or whether they are presented so that a person can visually identify them, or it is used to represent the processing of a printing medium.

The term "printing medium" represents not only the paper employed by a common printing apparatus, but also a general class of materials that can accept ink, such as cloth, plastic film, metal sheets, glass, ceramics, wood or leather.

In addition, "ink" should be interpreted as broadly as the above described definition of "printing". The term "ink" represents a liquid that, when applied to a printing medium, is used for forming an image, a mark or a pattern, for processing a printing medium, or for treating ink (e.g., to induce coagulation or the acquisition of insolubility of a color material in ink to be applied to a printing medium).

First Embodiment

First, an overview of the configuration of a printing system according to a first embodiment of the present invention will be described while referring to FIGS. 1A and 1B to FIG. 6, FIG. 12, FIG. 13 and FIGS. 15A to 15C. The printing system includes: a printing apparatus, which employs a printing head for the printing of a printing medium; and an external device (a host), which supplies image data to the printing apparatus.

Figure 1A:
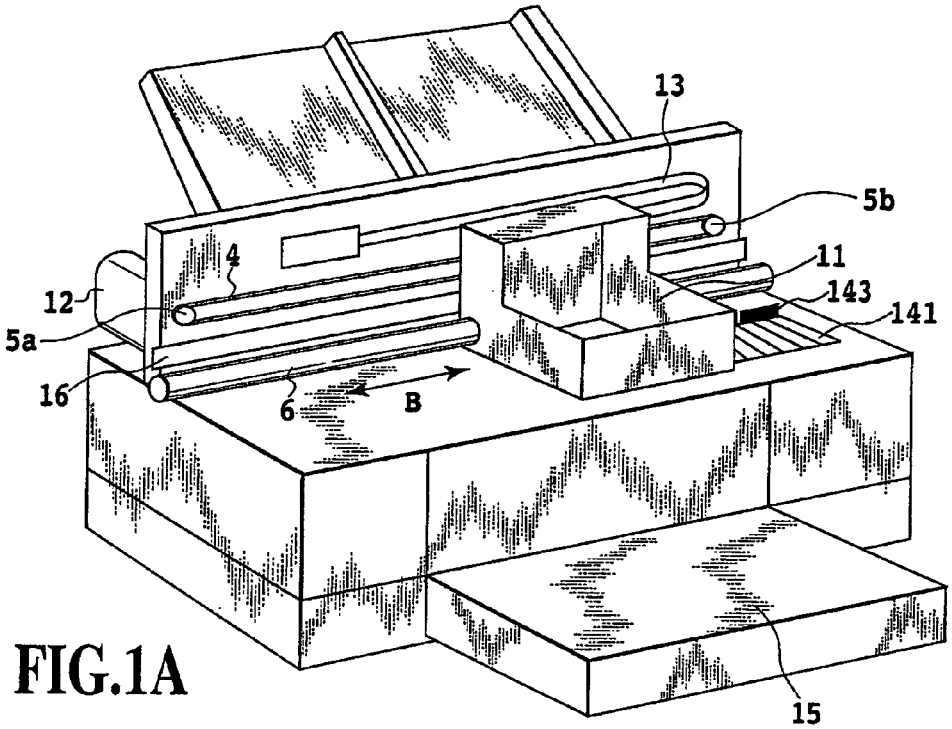
FIGS. 1A and 1B are a schematic perspective view and cross-sectional side view for explaining the configuration of an inkjet printing apparatus applied to the present invention.
Figure 1B:
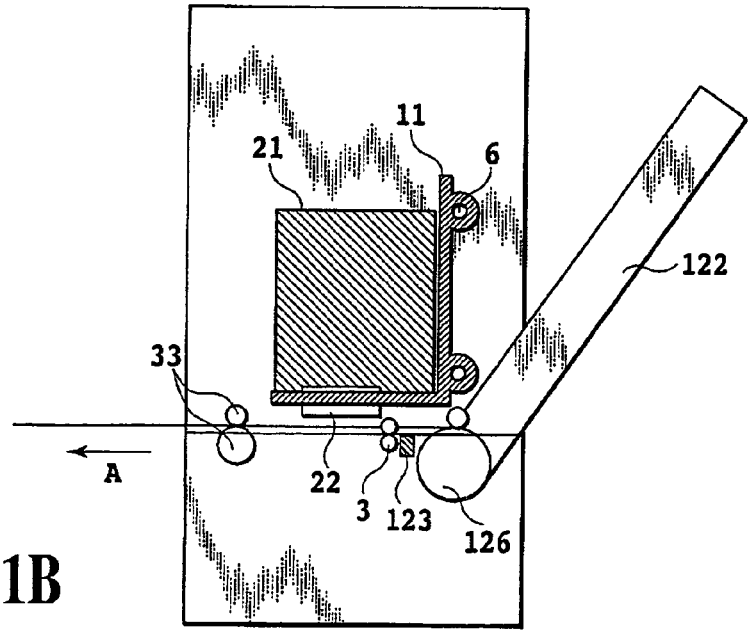
Figure 2:
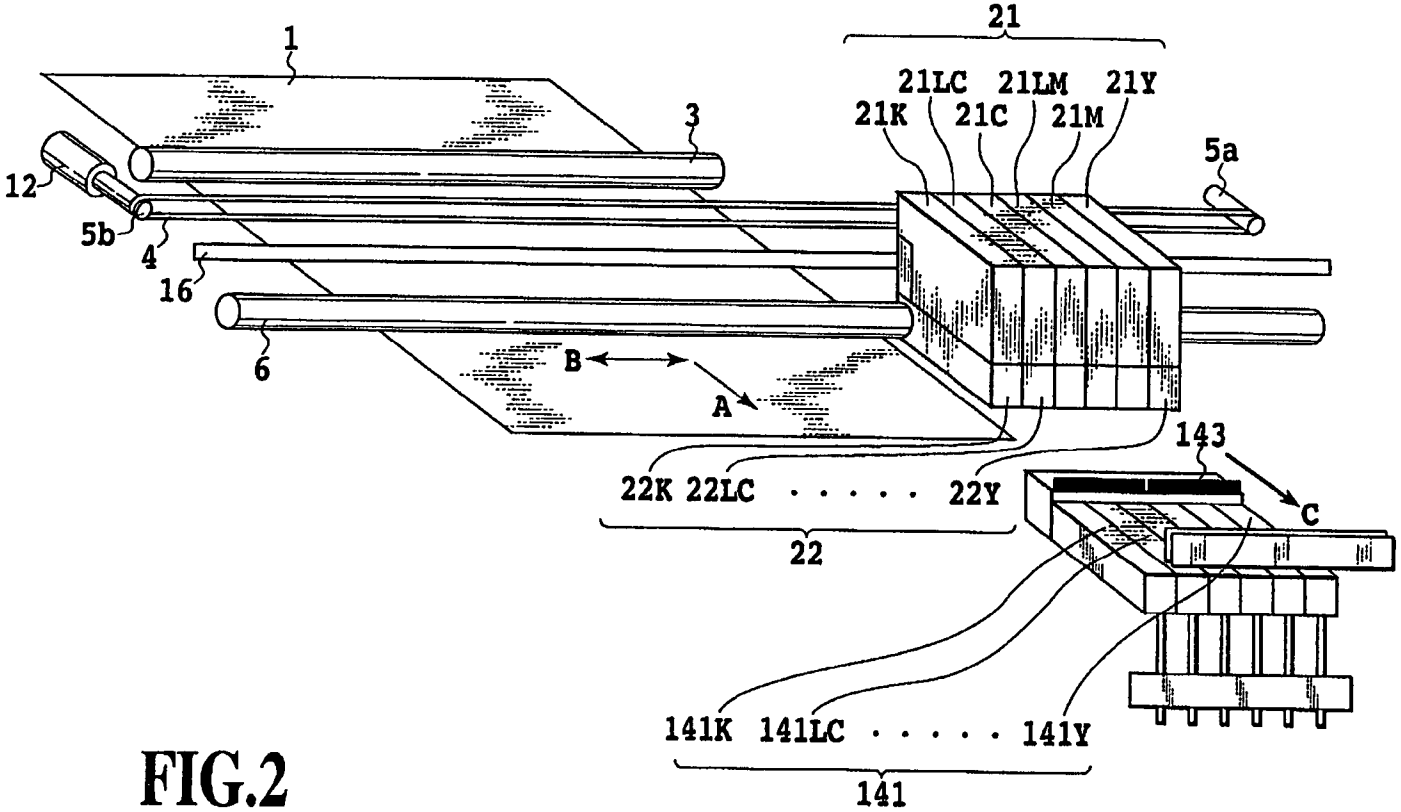
FIG. 2 is a schematic perspective view for explaining the arrangement of a serial inkjet printing apparatus.

FIGS. 1A and 1B are a perspective view and a cross-sectional side view for explaining the overview of the configuration of an inkjet printing apparatus that can be applied for the invention. FIG. 2, which was previously referred to, is a diagram for explaining the arrangement of the printing section of the inkjet printing apparatus.

Referring to FIGS. 1A, 1B and 2, a head cartridge is constituted by printing heads 22 and ink tanks 21, for supplying ink to the individual printing heads 22, and is detachably mounted on a carriage 11. A driving force, produced by a carriage motor 12, is transmitted to the carriage 11, via a belt 4 that is extended between and fitted around two pulleys 5*a* and 5*b*, and reciprocally impels the carriage 11, along a guide shaft 6, in the main scanning direction (the direction indicated by an arrow B). At this time, since the carriage 11 can read a pattern recorded on an encoder film 16, the carriage 11 can constantly obtain its current position. Further, a flexible cable 13 is connected to and follows the movement of the carriage 11, and a circuit board, which is installed within the main body of the printing apparatus, transmits print signals to the printing heads 22.

Caps 141 are used for the suction removal of ink from the printing heads 22, or for preventing ink on the printing heads 22 from drying when printing is not being performed. A wiper blade 143 is used to clean the discharge port faces of the printing heads 22 by removing excess ink. The carriage 11 returns the printing heads 22 to the home position, as needed, where a recovery process, such as suction or wiping, is performed to the printing heads 22. Furthermore, although not shown, along one side at the home position a preliminary discharge reservoir is provided for accepting ink that is discharged as not relevant to the printing process. When a non-printing state is continued for a specific period of time, a volatile component in ink may be evaporated in the vicinity of the discharge ports and the ink may change in quality. Therefore, periodically or as needed, the printing heads 22 are moved to the location of the preliminary discharge reservoir and a preliminary discharge process is performed. Through this process, an appropriate discharge state can be maintained for the printing heads 22.

Figure 3:
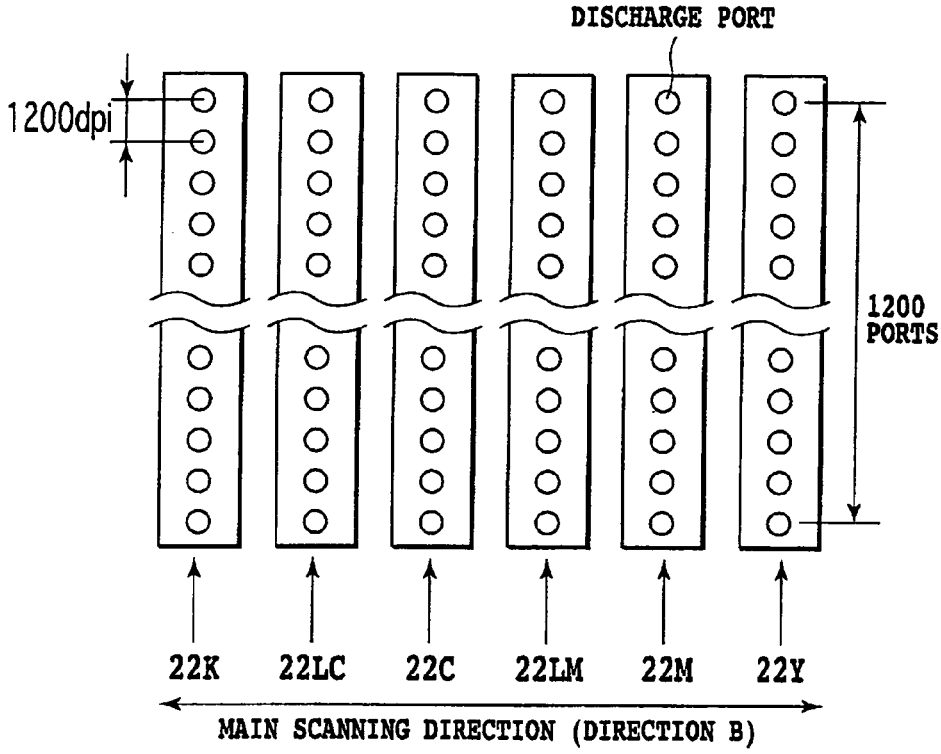
FIG. 3 is a schematic diagram showing the state of ink discharge ports arranged in printing heads.

FIG. 3 is a schematic diagram showing the state of the ink discharge ports arranged in the printing heads 22. In this embodiment, 1200 discharge ports are arranged in a printing head 22, in the sub-scanning direction, at 1200 dpi (dot/inch) intervals. That is, the printing heads 22 of this embodiment have a printing width of about one inch in the sub-scanning direction. According to the printing heads 22 of this embodiment, the area of an opening is so designated that the amount of ink discharged is reduced as much as possible to provide high quality printing, and each time the printing heads are driven, an ink droplet of about 4 ng can be discharged from each discharge port.

(Property of Ink)

The property and the components of the ink employed for this embodiment will now be explained. In this embodiment, there is a great difference in the properties of the black and the other color inks. For the black ink, a pigment is provided as a color material, and the ink has a comparatively low permeation speed (a low permeation property). For the other color inks, dyes are provided as the color materials, and these inks have comparatively high permeation speeds (high permeation properties).

The permeation of ink can be represented by a Ka value ($mL/m^2 \cdot ms^{1/2}$) obtained by the Bristow method, and when an ink has a large Ka value, its permeation is high. Therefore, as an example for this embodiment, a set of inks can be employed that satisfy the relationship, the Ka value of black ink<the Ka value of other color inks.

Figure 12:
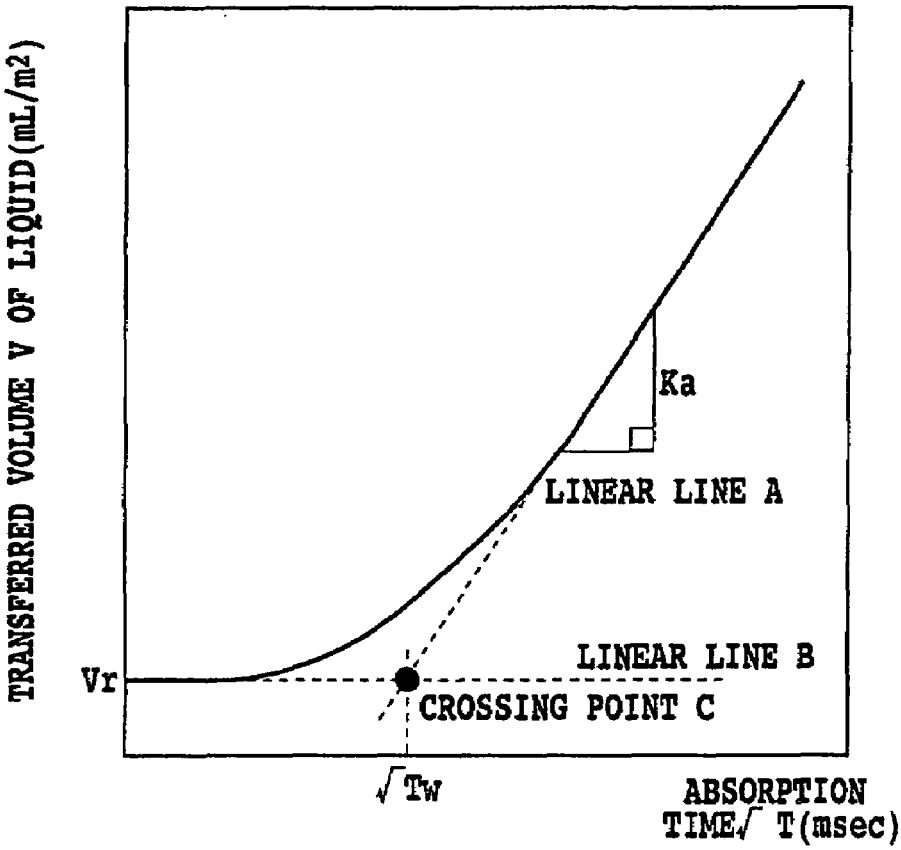
FIG. 12 is a graph showing an absorption curve by the Bristow method.

The Bristow method will now be briefly explained. The Bristow method is described in "Paper and board liquid absorption testing method", JAPAN TAPPI, pulp testing method No. 51. When the permeation of ink is represented by using an ink volume V per 1 $m^2$, the volume V ($mL/m^2$=μm) of the ink that has permeated a printing medium following the elapse, since an ink droplet was discharged, of a time t is represented by the following expression (1) using the Bristol method. The absorption curve for this expression is shown in FIG. 12.

$$V=Vr+Ka(t-tw)^{1/2} \quad (1)$$

where t>tw

Immediately after ink is discharged onto a printing medium, most of the ink is absorbed by the raised and recessed portions of the surface of the printing medium (the rough surface area of the printing medium), but hardly any enters the interior of the printing medium (in the direction of the depth). This occurs during a period tw (wet time), and the amount of ink absorbed by the raised and recessed portions is Vr. When the time that has elapsed following the discharge of ink exceeds tw, the permeating ink volume V is increased in proportion to the square root of the additional time (t−tw). Ka($mL/m^2 \cdot ms^{1/2}$) is the proportional coefficient of this increase, and is a value consonant with the permeation speed.

The Ka value can be measured by employing a dynamic liquid permeation testing apparatus (e.g., product name: dynamic permeation testing apparatus S, by Toyo Seiki Seisaku-Sho Ltd.) and using the Bristol method. In this embodiment, plain paper, such as PB paper (by Canon Inc.) for an inkjet printer or PPC paper for an electrophotographic copier, is employed as a printing medium for measuring the Ka value. Further, a normal environment, such as that of an office for which a temperature of 20°C. to 25°C. and a humidity reading of 40% to 60% is maintained, for example, is employed as a measurement environment.

The permeation of ink can be represented by using surface tension (mN/m) instead of the Ka value, and when the surface tension is low, the permeation is high. Therefore, as an example for this embodiment, a set of inks may be employed that satisfies the relationship, the surface tension of black ink>the surface tension of color ink.

In order to adjust the permeation of ink, a conventional, well known method can be employed, e.g., the content of a permeation accelerating agent, such as a surface-active agent, is adjusted, or the content of a highly permeating organic solvent is adjusted. For example, when the amount of a surface-active agent contained in a color ink is increased until it is greater than that of black ink, the permeation of the color ink can exceed that of the black ink.

In this embodiment, inks having different permeation properties are employed. In this case, inks that have different permeation properties are inks that have different Ka values or inks that have different surface tensions.

Further, of the color inks employed for this embodiment, at least one color ink (e.g., cyan ink) contains a component (a reaction agent) that reacts with black ink, and in this case, a conventional, well known reaction agent can be employed. The reaction agent reacts with the pigment contained in black ink, or the dispersing agent of the pigment, and destroys the dispersed state of the pigment in the black ink and causes it to coagulate.

As a preferable reacting agent, polyvalent metallic salt or polyamine is employed. Polyvalent metallic salt is formed of polyvalent metal ions and anions coupled with these ions. Specific examples of polyvalent metal ions are divalent metal ions, such as $Ca^{2+}$, $Cu^{2+}$, $Ni^{2+}$, $Mg^{2+}$, $Zn^{2+}$and $Ba^{2+}$ and trivalent metal ions, such as $Al^{3+}$, $Fe^{3+}$, $Cr^{3+}$and $Y^{3+}$. However, the metal ions that can be used are not limited to the ones named. In addition,the anion for forming salt is, for example, $Cl^-$, $NO^{3-}$, $I^-$, $Br^-$, $ClO^{3-}$, $So_4^{2-}$, $CO_3^{2-}$, $CH_3COO^-$or $HCOO^-$. The anion is not hereby limited, however.

Example compositions for black ink and inks of other colors that can be applied for this embodiment are shown below. It should be noted that the following compositions are provided for four colors of ink, black (Bk), cyan (C), magenta (M) and yellow (Y), and diluted magenta (M) and cyan (C) inks are employed for light magenta (LM) and light cyan (LC).

| Black ink (Bk) | |
|---|---|
| anionic carbon black | 3 parts |
| diethylene glycol | 15 parts |
| glycerin | 10 parts |
| acetylenol EH (by Kawaken Fine Chemicals Co., Ltd.) | 0.1 parts |
| water | remaining part |

| Cyan ink (C) | |
|---|---|
| C.I. direct blue 199 | 3 parts |
| diethylene glycol | 15 parts |
| isopropyl alcohol | 2 parts |
| pentanediol | 10 parts |
| 2-pyrrolidone | 10 parts |
| acetylenol EH (by Kawaken Fine Chemicals Co., Ltd.) | 1 part |
| magnesium nitrate | 2 parts |
| water | remaining part |

| Magenta ink (M) | |
|---|---|
| C.I. acid red 238 | 3 parts |
| diethylene glycol | 15 parts |
| isopropyl alcohol | 2 parts |
| urea | 5 parts |
| acetylenol EH (by Kawaken Fine Chemicals Co., Ltd.) | 1 part |
| water | remaining part |

| Yellow ink (Y) | |
|---|---|
| C.I. direct yellow | 3 parts |
| diethylene glycol | 15 parts |
| isopropyl alcohol | 2 parts |
| urea | 5 parts |
| acetylenol EH (by Kawaken Fine Chemicals Co., Ltd.) | 1 part |
| water | remaining part |

In this example, acetylenol (a product name) is employed as a surface-active agent that is a permeation accelerating agent, and the permeation between black ink and color inks is adjusted by providing different acetylenol contents for the black ink and the color inks. Specifically, a greater content of acetylenol is provided for color inks than for black ink, so that the permeation of color inks is adjusted and is higher than that of black ink.

Further, calcium nitrate is employed as a polyvalent metallic salt that is contained in color ink (cyan ink in this example). This calcium nitrate coagulates anionic carbon black (a pigment) contained in black ink. Therefore, much of the pigment in black ink remains on the surface layer of the printing medium, and a black image area having a high density is obtained.

Compositions other than the above example can be employed for this embodiment, and the set of ink described in Japanese Patent Laid-Open Publication No. 2002-307671, for example, can also be employed.

Various methods for discharging ink from individual discharge ports can be employed. For example, a method can be employed whereby an electric signal is applied to a heat generation device (an electric-heat energy conversion device) to cause a state change of the ink as well as a sharp volume change (the generation of bubbles), and whereby, by the action force based on the state change, ink is discharged from discharge ports. Or, a method can be employed whereby the ink pressure is changed by mechanical fluctuation and ink is discharged from discharge ports (nozzles).

A specific printing operation will now be explained.

While referring to FIG. 1B, upon receiving a printing instruction, a feed roller 126 is rotated and feeds, to the inside of the apparatus, the topmost printing medium 1 of those stacked on a sheet tray 122. The printing medium 1 is gripped by a conveying roller pair 3, and a printing area where printing operation is performed by the printing heads 22 is held smoothly.

A paper end sensor 123 is arranged near the feed position of the printing apparatus, and detects the end position of the printing medium 1. Since the printing medium 1 is conveyed based on its detected position, the registration of images can be performed.

Figure 13:
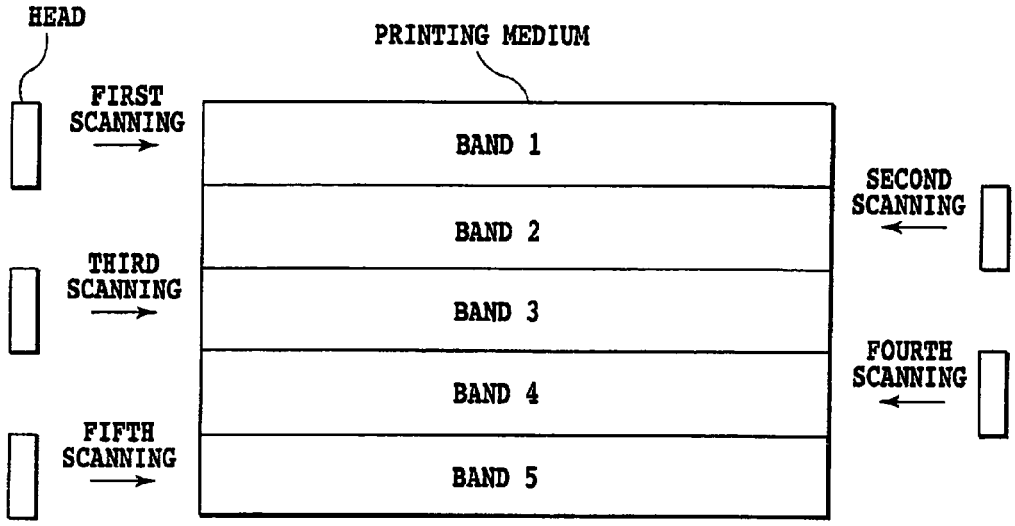
FIG. 13 is a diagram showing the process for forming bands.

When the printing medium 1 has been conveyed to a predetermined position, the carriage 11 is moved forward in the direction indicated by the arrow B, and the printing heads 22 discharge ink in accordance with print data. At this time, the printing heads 22 obtain a discharge timing in accordance with a pattern recorded on the encoder film 16. Through the first scan performed by the printing heads 22, a band (band 1) shown in FIG. 13 is formed. In this embodiment, since the printing heads 22 in FIG. 3 are employed, the width of a single band is one inch.

When one scan in the forward direction has been completed, the conveying roller pair 3 is rotated and conveys the printing medium 1, in the direction indicated by an arrow A, a distance equivalent to the printing width of the printing heads 22 (one inch in this case). When the printing medium 1 has been conveyed, the printing heads 22 are moved in the reverse direction indicated by the arrow B and perform printing in accordance with print data for the next band (band 2). Thus, band 2 in FIG. 13, that has a width of one inch, is formed. When the printing for one scan and conveying of the printing medium a predetermined distance are repeated in this manner, images for individual bands are sequentially formed on the printing medium 1. It should be noted that a "band" indicates an image area to be printed by one scan of the printing heads 22.

When data for one page has been printed for the printing medium 1, the printing medium 1 is discharged to a discharge tray 15 by the conveying roller pair 3 and discharge rollers 33. In this manner, the thus printed printing mediums are sequentially stacked on the discharge tray 15.

Figure 15A:
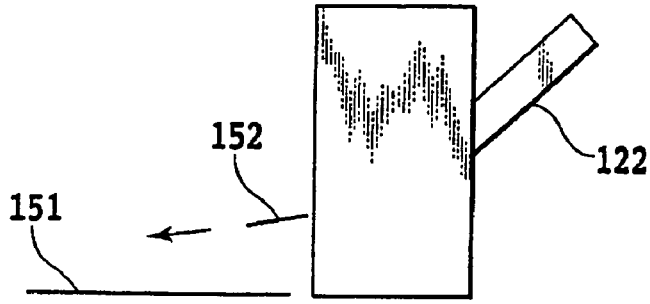
FIGS. 15A, 15B and 15C are diagrams showing the state wherein a currently printed printing medium contacts a discharged printing medium.
Figure 15B:
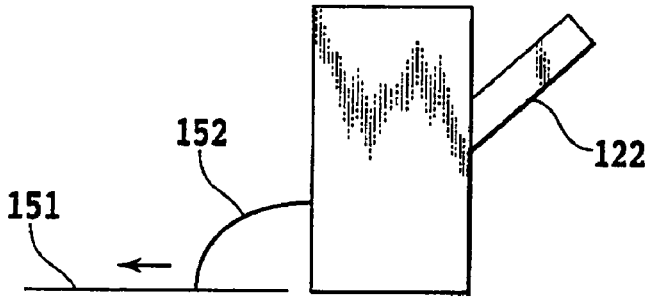
Figure 15C:
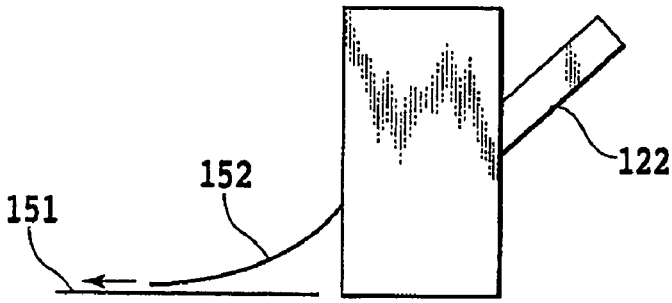

FIGS. 15A to 15C are diagrams showing the state of the printing apparatus wherein the printing medium is discharged to the discharge tray. In the state shown in FIG. 15A, a preceding page (a preceding printing medium) 151 is discharged, and while a current page (a current printing medium) 152 is being printed, this printing medium 152 is advanced about three inches. In the state in FIG. 15B, printing is advancing, and the printing of the current printing medium 152 is continued for another six inches, so that the leading edge of the current printing medium 152 contacts the preceding printing medium 151 that has already been discharged. In the state shown in FIG. 15C, printing is further advanced, and the paper end sensor 123 in FIG. 1B has detected the trailing end of the current printing medium 152.

Figure 4:
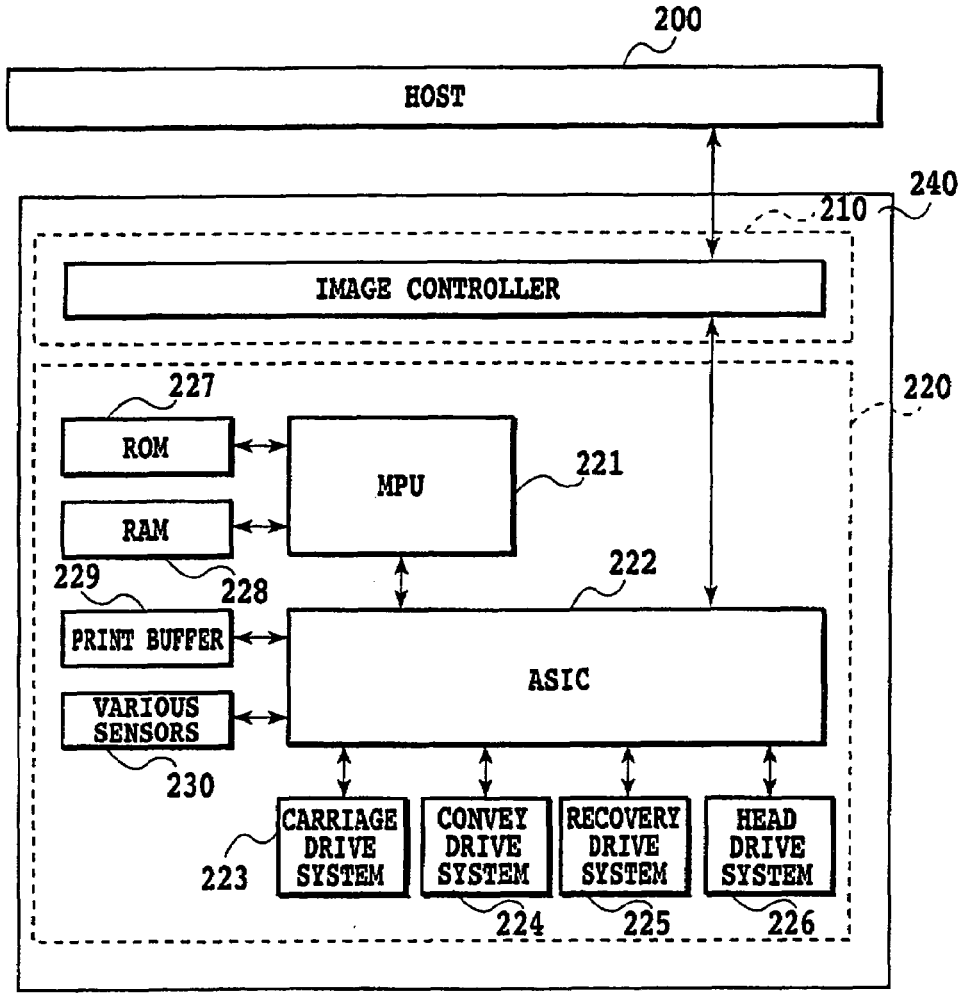
FIG. 4 is a block diagram for explaining the control configuration of an inkjet printing apparatus applied to the present invention.

FIG. 4 is a block diagram for explaining the control configuration of an inkjet printing apparatus that can be applied for the present invention. An inkjet printing apparatus 240 in this embodiment receives image data from a host (a data supply apparatus) 200 connected by an interface, such as a USB. An image controller 210 analyzes and develops the image data received from the host 200, and finally generates binary image data for individual colors. Further, in accordance with a command directly entered at the main body of the printing apparatus 240, the image controller 210 transmits a control command to a print engine 220. The print engine 220 controls the actual printing operation based on the control command and the image data received from the image controller 210.

The image controller 210 and the print engine 220 are connected by a special interface. Through this interface, command transmission for transmitting a control command from the image controller 210 to the print engine 220, status transmission for transmitting a notification of an apparatus status change from the print engine 220 to the image controller 210, and the transmission of image data from the image controller 210 to the print engine 220 are performed.

The print engine 220 is controlled by an MPU (Micro Processor Unit) 221 in accordance with a program stored in a ROM 227. At this time, a RAM 228 is employed as a work area for the MPU 221 or as a temporary data storage area. The MPU 221 controls, through an ASIC (application Specific Integrated Circuit) 222, a carriage drive system 223, a conveying drive system 224, a recovery drive system 225 and a head drive system 226. Furthermore, also through the ASIC 222, the MPU 221 can read data from and write data to a print buffer 229. The print buffer 229 is employed to temporarily store image data that are converted into a form that can be transferred to the printing heads 22. Further, the MPU 221 obtains information detected by various sensors 230, provided inside the printing apparatus 240, and employs the information to control the individual mechanisms.

When the image controller 210 receives the image data from the host 200, the printing operation is started. The image controller 210 analyzes the received image data and generates necessary printing information, such as a printing mode and margin information. The image controller 210 further analyzes and develops the image data to convert the gray image data to binary image data for the individual colors. The information, such as the printing mode and margin information, that is required for the printing operation performed by the print engine 220 is transmitted to the print engine 220.

In the print engine 220, the MPU 221 processes the received information and temporarily stores the resultant information in the RAM 228. This information is referred to later, as needed, and is employed for sorting the processes.

When transmission of the required information has been completed, the image controller 210 transmits to the print engine 220 the binary image data for individual colors obtained by conversion. The print engine 220 then stores the binary image data in the print buffer 229. As the binary image data are repetitively received from the image controller 210, the print engine 220 accumulates and stores them in the print buffer 229.

When the amount of binary image data accumulated in the print buffer 229 reaches the amount available for one scan, the MPU 221, through the ASIC 222, permits the conveying driving system 224 to feed and convey a printing medium 1 and the carriage drive system 223 to move the carriage 11. Further, the recovery drive system 225 drives the recovery system to perform a necessary recovery process before the printing operation starts. In addition, the MPU 221 permits the ASIC 222 to designate the image output position, and drives the carriage 11 to start the printing operation. When the carriage 11 is moved and reaches the printing start position designated by the ASIC 222, image data are sequentially read from the print buffer 229 in consonance with the discharge timing. The binary image data that are read are employed as print data, and are transmitted to the printing heads 22. Under the control of the head drive system 226, the printing heads 22 discharge ink in accordance with the received print data.

Figure 5:
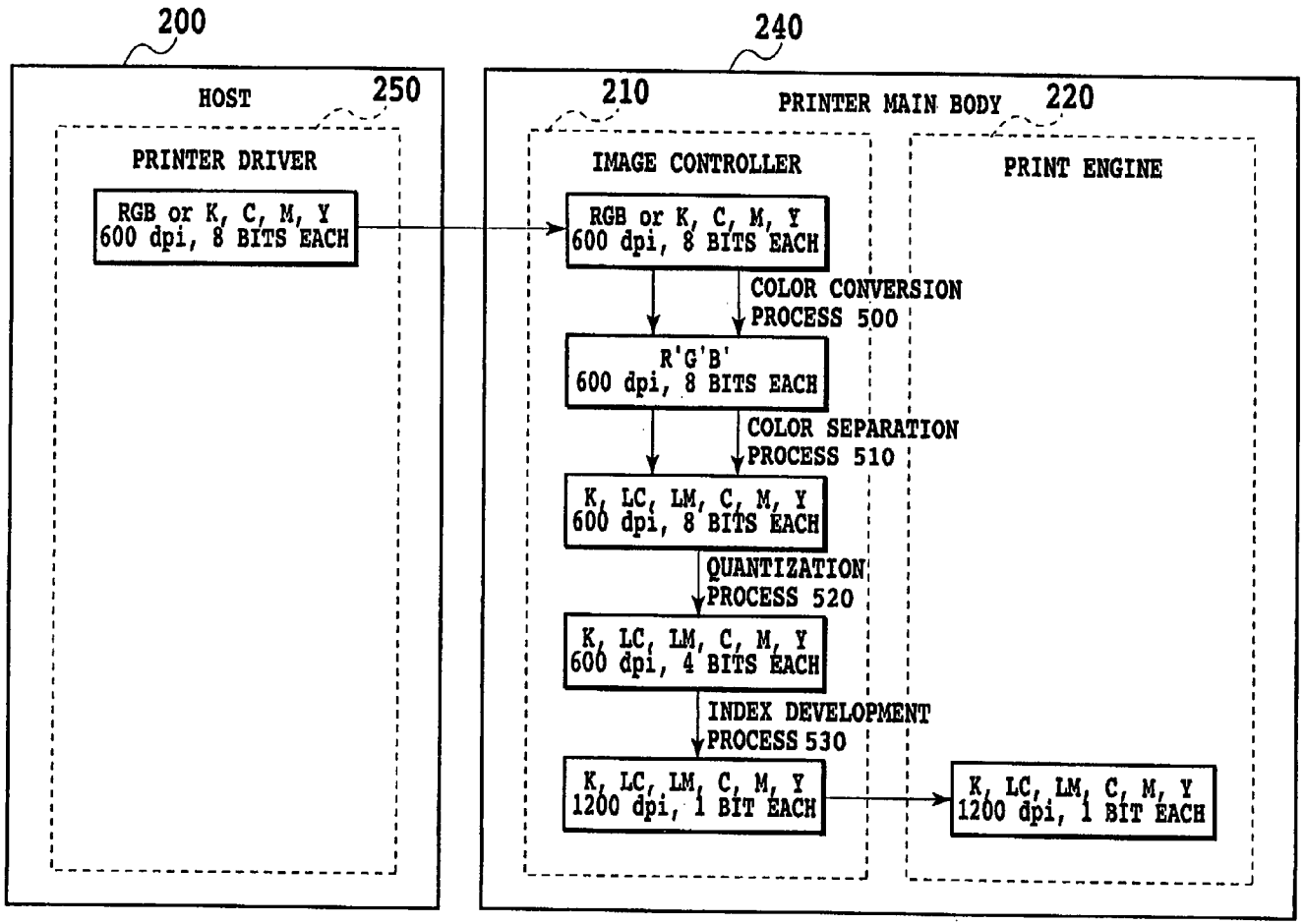
FIG. 5 is a diagram for explaining the image data processing performed by a host and the main body of a printing apparatus.

FIG. 5 is a diagram for explaining the image data processing performed by the host 200 and the printing apparatus 240. In this embodiment, a printer driver 250 installed in the host 200 converts image data into eight bit RGB (red, green and blue) luminance data for a 600×600 dpi print area. In this state, the RGB luminance data are transferred to the printing apparatus 240.

The image controller 210 converts the 8-bit RGB data into 8-bit R'G'B' data in order to compensate for a color space that matches the printing apparatus 240 (color conversion process 500). Sequentially, the image controller 210 converts the 8-bit R'G'B' data into gray data for K, LC, LM, C, M and Y (8 bits each) for a 600×600 dpi area (color separation process 510) in order to separate into the colors which can be used in the apparatus. During the color conversion process 500 and the color separation process 510, a previously prepared lookup table is employed to perform the conversion. The lookup table may be stored in the ROM 227 of the printing apparatus 240, or may be received from the host 200.

Following this, the image controller 210 converts the 8-bit K, LC, LM, C, M and Y data (255 tones) into 4-bit data for the individual colors (five tones) (quantization process 520). A well known error diffusion method or the dither method can be employed for the quantization process 520. Thereafter, an index development process 530 is performed for the quantized 4-bit data (five tones) for K, LC, LM, C, M and Y.

Figure 6:
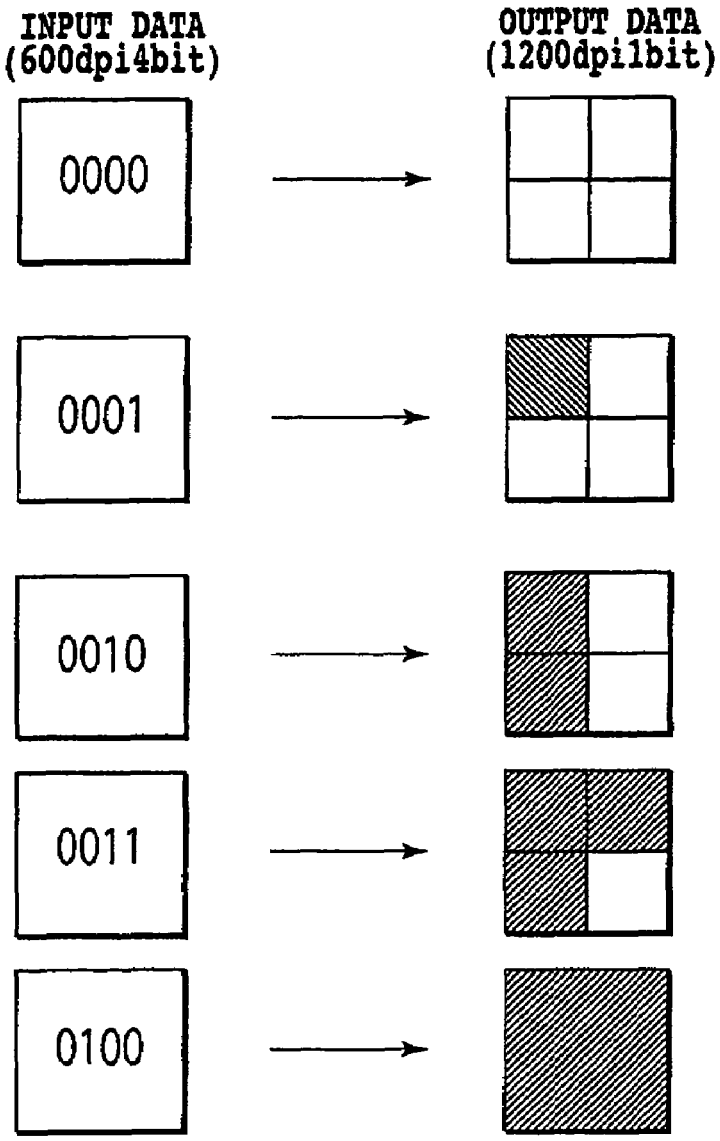
FIG. 6 is a schematic diagram for explaining an index development process.

FIG. 6 is a schematic diagram for explaining the index development process 530. In this embodiment, the image controller 210 performs index development for 4-bit data (five tones) for 600 dpi to obtain one-bit data (two tones) for 1200 dpi. In FIG. 6, input data shown on the left side are 4-bit data obtained by quantization, and tone information for five tones is included. Output data on the right side that correspond to the individual tones are binary data indicating printing or non-printing that are obtained by the index development. The output data is formed for 2 ×2=four areas, and one area corresponds to one pixel of 1200×1200 dpi. Each area is defined by a binary value indicating whether or not printing is to be performed. When input data represents the lowest level (0000), dots for output data are not printed in any area. As the input data level is raised, the number of dots printed for output data is gradually increased, and when the input data represents 0100, dots are printed in all four areas. This index pattern may be stored in the ROM 227 of the printing apparatus 240, or may be received from the host 200.

In this embodiment, the index development process 530 is performed in order to reduce the processing load while RGB gray data are employed, and to improve the gradation, so that an increase in the printing speed and in the image quality can be obtained. It should be noted, however, that in this embodiment the performance of the index development process 530 is not always required.

The binary data obtained by the index development process 530 are is transmitted to the print engine 220, and are, as described above, stored in the print buffer 229. The print engine 220 controls the printing heads 22 and the individual drive system in accordance with 1-bit data (two tones) for K, LC, LM, C, M and Y and other information. When the printing heads 22 discharge ink in accordance with binary data for individual colors that are read from the print buffer 229, an image is printed at a resolution of 1200×1200 dpi.

Characteristics of this Embodiment

An explanation will now be given for a specific smear countermeasure provided for this embodiment by employing the inkjet printing apparatus having the above described arrangement.

Figure 17:
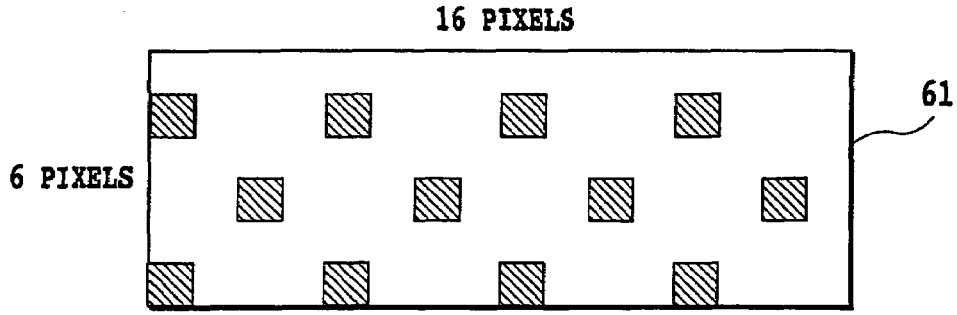
FIG. 17 is a diagram showing the arrangement of smearing reduction color dots that are designated in accordance with color ink provision mask pattern data.
Figure 18:
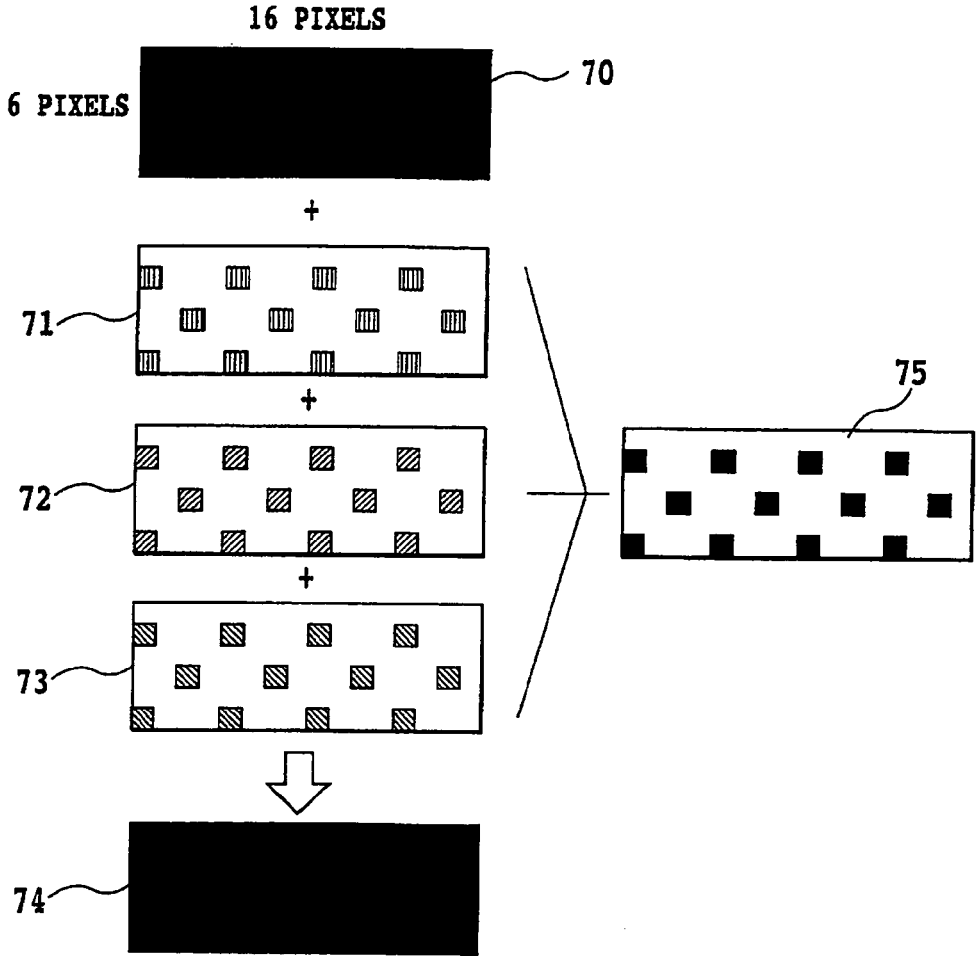
FIG. 18 is a diagram showing the state wherein smearing reduction CMY dots are superimposed and printed in a black image area at a high duty.

In this embodiment, to shorten the fixing time for a high duty black image area that is slow fixing, highly permeant color ink is applied to a black image area wherein low permeant black ink is applied at a high duty. That is, as shown in FIGS. 16 to 18, a high duty black image area is detected, and color data consonant with the black image area are generated so that highly permeant color ink (CMY) can be applied in this black image area.

In this embodiment, of five color inks (C, M, Y, LC and LM), three color inks (C, M and Y) are to be applied for smear attenuation. However, all the five color inks (C, M, Y, LC and LM) may be applied as color inks for smear attenuation. In this case, the same process as is used for CMY inks is performed for LC and LM inks.

While referring to FIGS. 16 to 18, a detailed explanation will now be given for the processing for the generation of color data based on black data, so that for smear attenuation, color inks can be applied to a high duty black image area.

Figure 16:
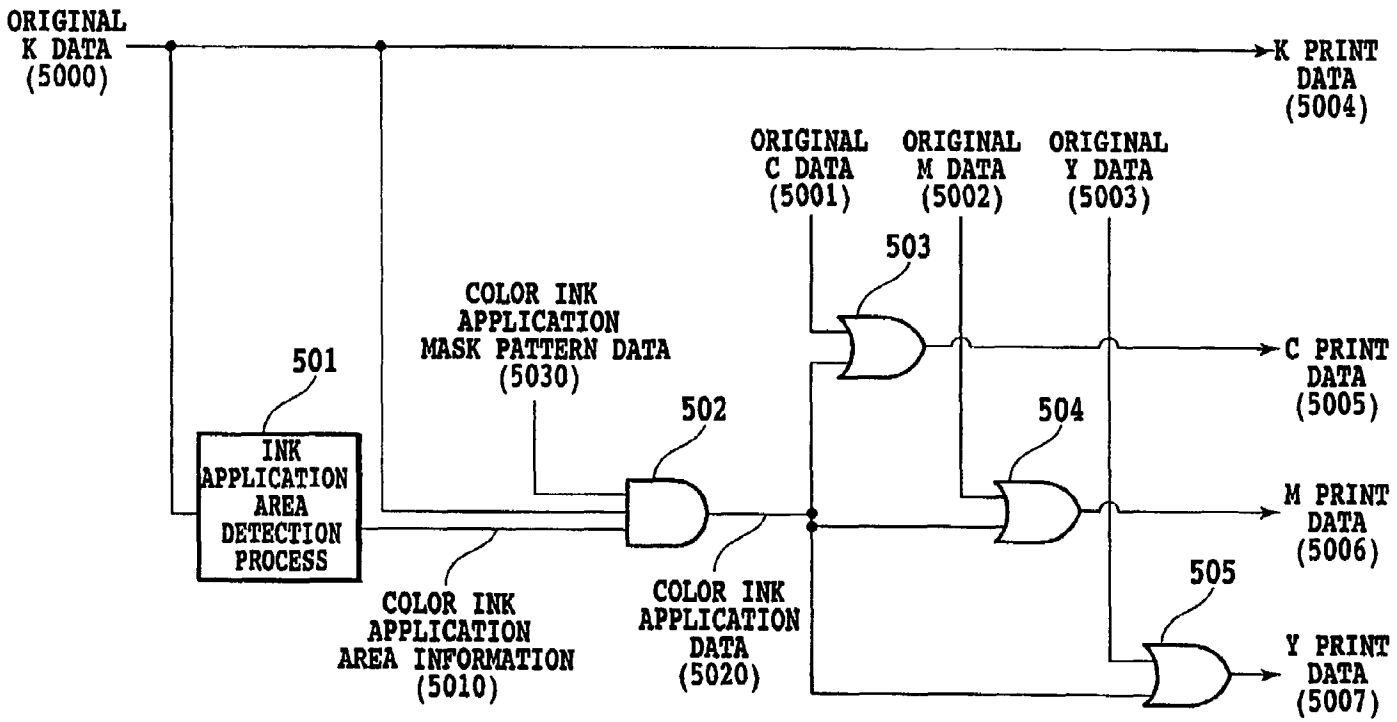
FIG. 16 is a block diagram for explaining the process for generating, from black data, color data used for smearing reduction.

FIG. 16 is a block diagram for explaining the processing for generating, from original black data, color data used for smear attenuation. During a color ink application area detection process 501, a high duty area is detected based on original black (K) data 5000 (black binary image data) that are stored in the print buffer 229. The detection of a high duty area is performed in the following manner.

Figure 8:
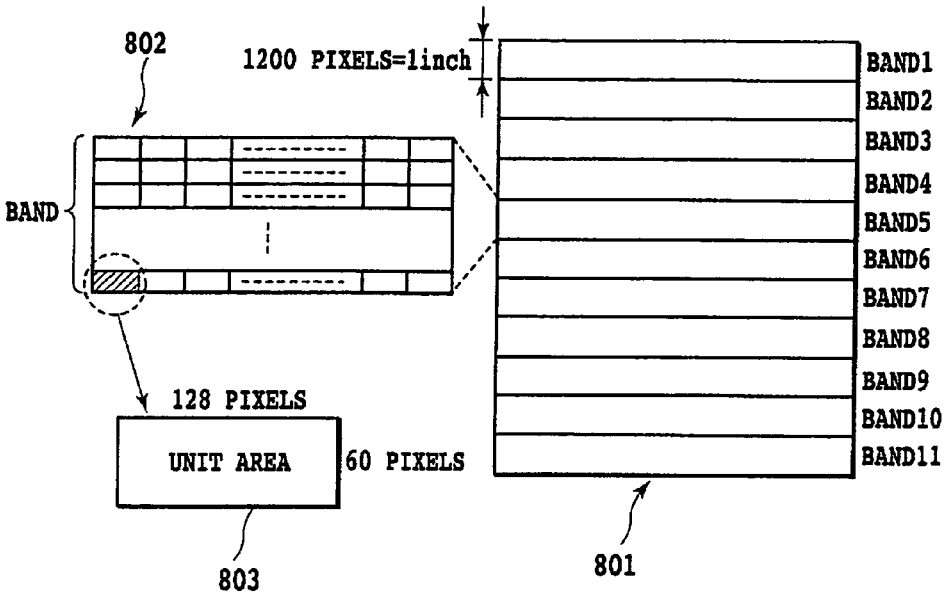
FIG. 8 is a diagram for explaining a unit area (a check box) for detecting a printing ratio (a duty)

FIG. 8 is a diagram for explaining a unit area (a check box) for detecting a printing ratio (a duty). In FIG. 8, an entire printing area 801 is divided into a plurality of bands, each of which has a height that is equivalent to the width of a printing scan. Further, an enlarged band 802 is shown, and is divided into a plurality of unit areas 803. In this embodiment, each unit area 803 is an area of 128 pixels×60 pixels.

In this embodiment, to obtain the printing ratio, the MPU 221 counts the pixels in each unit area 803 for the printing of black ink. Then, the MPU 221 determines whether the obtained count is equal to or greater than a predetermined threshold value (e.g., 128 pixels×60 pixels (50/100)%=3840 dots). As a result of this determination, a unit area 803 wherein the count is equal to or greater than the threshold value, i.e., a unit area 803 where the black printing ratio is equal to or greater than 50%, is detected as a high duty area. The dot counting process for each unit area 803 can be performed when the MPU 221 counts the black binary image data stored in the print buffer 229.

Based on the printing ratio thus detected, color ink application area information 5010, which indicates whether color ink should be applied for smear attenuation, is generated for each unit area 803 (see FIG. 16). The color ink application area information 5010 is information that indicates whether the application of color ink is required for a target unit area 803, and is one-bit data. That is, when the application of color ink to a unit area 803 is required, the information 5010 indicates "1", or when the application of color ink is not required, the information 5010 indicates "0". Therefore, during the color ink application area detection process 501, "1" is set for the ink application area detection information 5010 for all the pixels that form the unit areas 803 that have been detected as high duty areas. On the other hand, "0" is set for the ink application area detection information 5010 for all the pixels that form the unit areas 803 that have not been detected as high duty areas.

Sequentially, the thus generated color ink application area information 5010, color ink application mask pattern data 5030 and original black data 5000 are transmitted to an AND gate 502. Then, the AND gate 502 obtains the logical product of these three sets of data, 5010, 5030 and 5000, and generates color ink application data 5020 that indicates the arrangement of the color dots that are actually to be applied to the black image area.

The color ink application mask pattern data 5030 is a pattern 61, shown in FIG. 17, for which the arrangement of color ink dots to be applied to the unit area 803 is defined. The size of the color ink application mask pattern data 5030 is the same as the size (128 pixels×60 pixels) of a unit area 803. Therefore, when the pattern 61, shown in FIG. 17, of 16 pixels×6 pixels is defined as the minimum unit, and when eight of the minimum units are repetitively arranged in the main scanning direction and ten of the minimum units are repetitively arranged in the sub-scanning direction, the color ink application mask pattern data 5030 of 128 pixels×60 pixels is obtained. It should be noted that in FIG. 17 the white portion of the mask pattern 61 is a mask portion (a non-printing pixel arrangement) and represents the pixels for which the discharge of ink is not permitted. Solid portions are pixels (printing pixels) for which the discharge of ink is permitted.

In this embodiment, 12.5% (see FIG. 17) is employed as the determined printing pixel rate in the color ink application mask pattern data 5030. The rate of printing pixels corresponds to the pixel rate wherein color ink is applied to a unit area. It is preferable that the size of the mask pattern data 5030 and the number of pixels for color dots that it has been determined is to be shown in the mask pattern data 5030 be appropriately designated, in accordance with the properties of the ink and the configuration of the printing apparatus. Further, the printing pixels in the mask pattern may be arranged regularly, or may be arranged in a pseudo random manner.

When the logical product of the three sets of data 5010, 5030 and 5000 is obtained in the above described manner, only the pixels for printing black dots can be extracted from the pixels that form a high duty black image area and are actually employed as the color ink application data 5020 for the application of color ink. That is, color ink is not applied to black dot non-printing pixels located among the pixels that form a high duty black image area.

Following this, C, M and Y print data are generated based on the color ink application data 5020 that have been generated. Specifically, an OR gate 503 calculates a logical sum for the color ink application data 5020 and original C data 5001 to generate C print data 5005. In this manner, C print data 5005 can be obtained that reflects both the arrangement of C dots in the original C data 5001 and the arrangement of C dots to be applied in the black image area. Similarly, an OR gate 504 calculates a logical sum for the color ink application data 5020 and original M data 5002 to generate M print data 5006. Further, an OR gate 505 calculates a logical sum for the color ink application data 5020 and original Y data 5003 to generate Y print data 5007. It should be noted that the original K data 5000 is employed unchanged as K print data 5004.

The thus obtained print data for the individual colors are stored in the print buffer 229. Since, as black print data, the original K data 5000 stored in the print buffer 229 can be employed without processing being required, restoring them in the print buffer 229 is not necessary. For the printing processing, these print data for the individual colors are read from the print buffer 229, and dot printing is performed based on the print data.

FIG. 18 is a schematic diagram showing the print positions of the print data 5005, 5006 and 5007 for the individual colors in the high duty image area (the 100% black image area in this embodiment) detected during the color ink application area detection process 501. The K print data 5004, denoted by 70, is the unchanged, original K data 5000 for which the duty is 100%, and is detected as a high duty image area during the color ink application area detection process 501. In the high duty image area, CMY dots are printed based on the C print data 5005, denoted by 71, the M print data 5006, denoted by 72, and the Y print data 5007, denoted by 73. As a result, a solid black image 74 is printed.

In FIG. 18, since CMY color dots are applied at the same positions (see 71, 72 and 73), a process black 75 is obtained by superimposing the CMY dots. Therefore, smearing can be attenuated while there is hardly any deterioration of the hue of the black image. However, the arrangement of the CMY dots applicable for this embodiment is not limited to this, and the arrangement of the CMY dots may differ, depending on the colors.

As described above, in this embodiment, the arrangement wherein low permeant black ink and high permeant color inks are superimposed and printed in the same area is employed for smear attenuation.

The present inventors employed the above described inkjet printing apparatus to review printing performed while low permeant black ink and high permeant color inks were superimposed in the same area. In this case, it was confirmed that when low permeant black ink was applied prior to high permeant color inks (CMY), a longer period of time was required to fix the ink to a printing medium than when high permeant color inks were applied first. Specifically, in a unit area that is a black high duty area (the black printing ratio is equal to or greater than 50%), the fixing period when black was applied first was three seconds, and the fixing period when black was applied later was about two seconds.

Here, the "fixing period" is the period of time required to ensure smear does not occur when a following printing medium (a current page) that is being printed contacts a printed unit area of a preceding printing medium (a previous page). That is, the "fixing period" can be defined as the period of time that must elapse before the following printing medium (the current page) is permitted to contact the printed unit area of the preceding printing medium (the previous page).

As a method for measuring the "fixing period", there is a method (a first method) whereby a printing medium to which ink has been applied is rubbed with a specified paper (e.g., Silbon paper), and whether ink is transferred to the paper is examined visually or by an optical sensor. According to the first method, the fixing period is the period required to fix ink to a printing medium so that the transfer of ink to a specified paper can not be identified visually or by an optical sensor. As another method, there is a method (a second method) whereby, on a printing medium to which ink has been applied, a printing medium of the same type is overlaid, and whether ink is transferred to the overlying printing medium is examined visually or by an optical sensor. According to the second method, the fixing period is the period required to fix ink to a printing medium, so that the transfer of ink to and overlying printing medium can not be identified visually or by an optical sensor. In this embodiment, the first of these various measurement methods, the one whereby a printing medium to which ink has been applied is rubbed with Silbon paper, is employed, and whether ink is transferred to the Silbon paper is examined visually.

While referring to FIGS. 14A and 14B, an explanation, based on an assumption of the present inventor, will now be given for the reason (the mechanism) that the fixing period differs depending on the ink application order (the order from low permeant ink to high permeant ink, or the order from high permeant ink to low permeant ink).

Figure 14A:
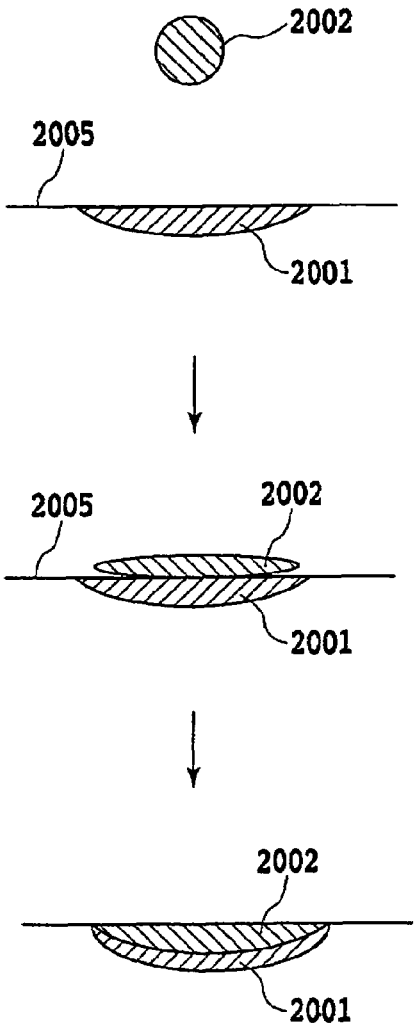
FIGS. 14A and 14B are diagrams for explaining that fixing times are different because the orders in which ink is provided differ.

FIG. 14A is a diagram showing the permeation state when high permeant color ink 2001 is applied to a printing medium and then low permeant black ink 2002 is applied. In this case, since the black ink 2002 is applied to the surface of a printing medium, the permeation of which has been increased by the color ink 2001, the black ink 2002 quickly permeates the printing medium. Therefore, the fixing period is comparatively short.

Figure 14B:
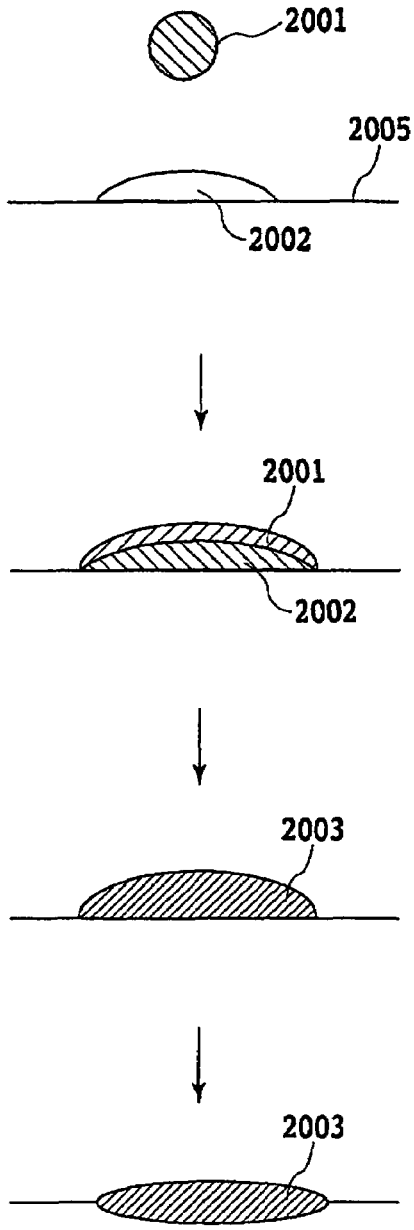

FIG. 14B is a diagram showing the permeation state when a low permeant black ink 2002 is applied to a printing medium and then a high permeant color ink 2001 is applied. In this case, since the permeation of the black ink 2002 is low, the high permeant color ink 2001 is applied to the black ink 2002, for which there is little permeation of the printing medium. At this time, since the surface of the printing medium is covered with the low permeant black ink 2002, permeation is not changed very much when the high permeant color ink 2002 is applied later. Specifically, when color ink 2001, applied second, contacts the black ink 2002, applied first, these inks mix together on the surface of the printing medium, and an ink mixture 2003, obtained at the initial mixing stage permeates the printing medium. However, regarding the permeation of the ink mixture 2003 at the initial stage, the low permeation of the black ink, applied first, is predominant. Therefore, the permeation of ink mixture 2003 does not begin smoothly, and the fixing period is comparatively long. It should be noted that when a predetermined period of time has elapsed since the start of the ink mixing, the permeation of the ink mixture 2003 gradually increases, and the ink mixture 2003 gradually permeates the printing medium. However, since the period required for the permeation to increase is comparatively long, the fixing period is extended, compared with the case shown in FIG. 14A.

As described above, using the method whereby low permeant black ink is applied after high permeant color ink, the fixing period is shorter than when the method is used whereby high permeant color ink is applied after low permeant black ink. That is, when inks having different permeation properties are employed, the fixing period differs, depending on the order in which the inks are applied. It should be noted that inks having different permeation properties are either inks having different Ka values or inks having different surface tensions.

Therefore, in this embodiment, the fixing period is determined, for each unit area shown in FIG. 8, while taking into account the ink application order employed for the unit area. Specifically, first, binary data stored in the print buffer 229 is employed to determine whether there is a high duty area wherein the black printing ratio is equal to or greater than 50%. When it is determined that a high duty area is present, the ink application order for the high duty area is identified.

High permeant color inks are applied to the black high duty area as explained while referring to FIGS. 16 to 18. The high duty area is to be printed in either the low permeant black ink to high permeant color inks order or the high permeant color inks to low permeant black ink order. Thus, a check must be performed to determine in which ink application order the high duty area was printed.

For bidirectional printing, as in this embodiment, the ink application order depends on the scanning direction. That is, when the scanning direction is determined, accordingly, the ink application order is determined. Therefore, in this embodiment, the scanning direction is identified so as to indirectly determine the ink application order. Specifically, a check is performed to determine whether the high duty area was printed by forward scanning or by reverse scanning. When it is determined that the high duty area was printed by forward scanning, a three second fixing period is set for the high duty area. But when it is determined that the high duty area was printed by reverse scanning, a two second fixing period is set for the high duty area. This is because the printing apparatus 240 of this embodiment applies black ink and then color inks during the forward scanning, but applies color inks and then black ink during the reverse scanning.

Hereinafter, for the sake of convenience, the state wherein black ink is applied prior to color inks, i.e., the state wherein the black ink is at the bottom of the superimposed inks, is called "bottom black ejection". On the other hand, the state wherein black ink is applied after color inks, i.e., the state wherein black ink is at the top of the superimposed inks, is called "top black ejection".

Figure 7:
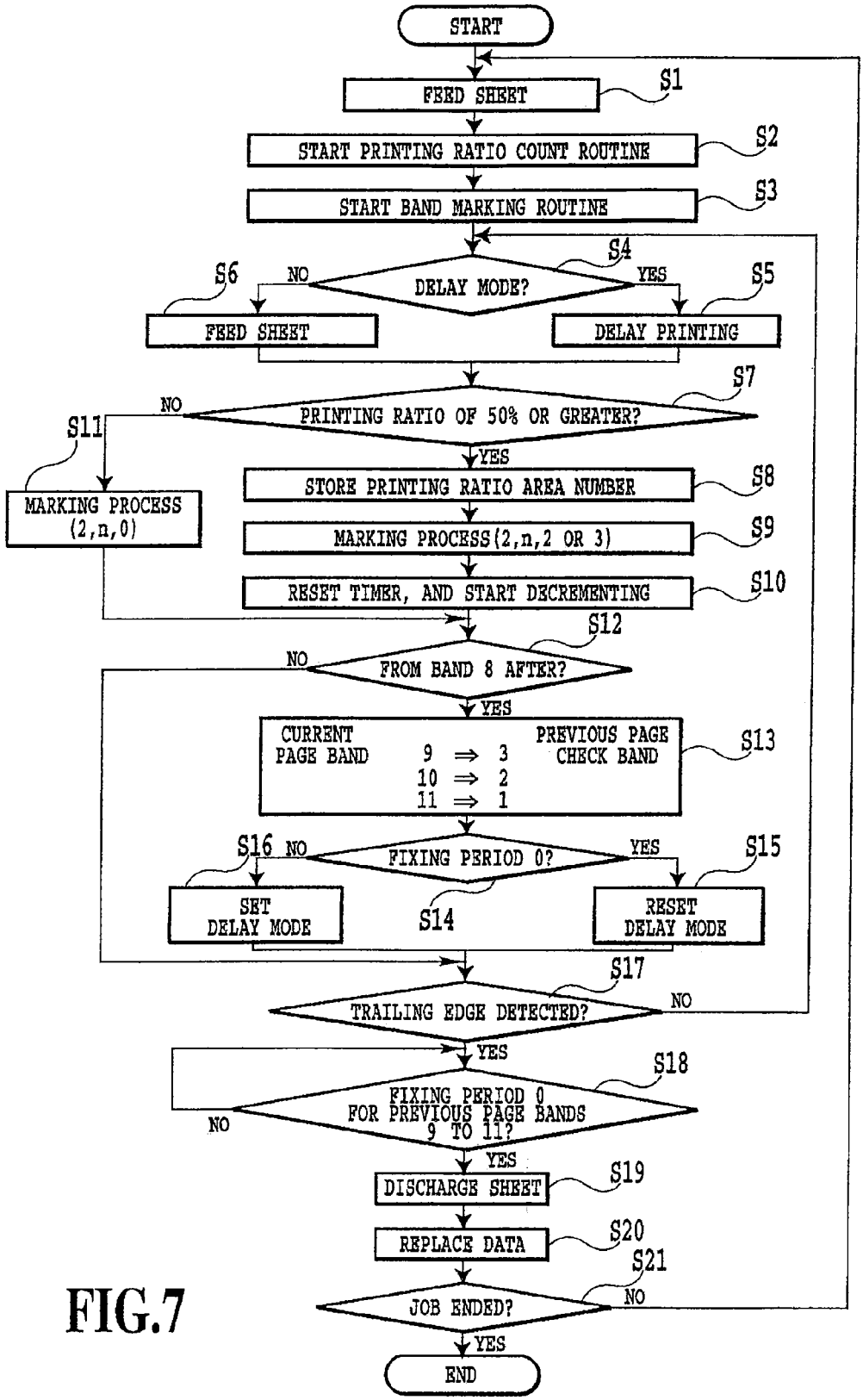
FIG. 7 is a flowchart for explaining a printing process performed by an MPU.

FIG. 7 is a flowchart for explaining the processing performed by the MPU 221 for this embodiment. When a job is begun, at Step 1, the first sheet is fed. At Step 2, the printing ratio count routine is reset and is then started. The printing ratio count routine is a routine for detecting the printing ratio of the black dots in a unit area (hereinafter also called a "check box") having the predetermined size shown in FIG. 8.

FIG. 8 is a diagram for explaining a unit area (check box) for detecting a printing ratio. In this embodiment, an area that has 128 pixels in the main scanning direction×60 pixels in the sub-scanning direction is employed as one check box, and the black printing ratio is detected for each check box. Specifically, black dots printed in a check box are counted to detect the black printing ratio in the pertinent area. Since the total dots printable in a check box are 128×60=7680 dots, the black printing ratio is D/7680×100(%) where D denotes the number of black dots to be printed in the check box. To count dots in the check box, binary data stored in the print buffer 229 need only be counted by the MPU 221.

Figure 9A:
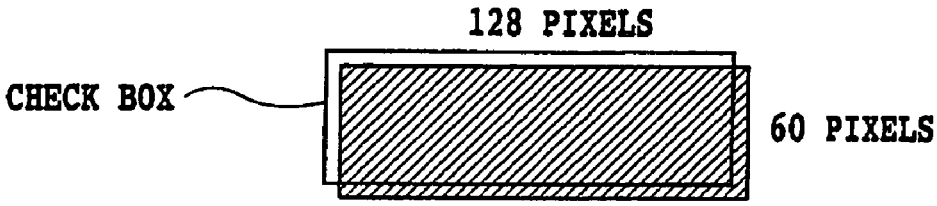
FIGS. 9A and 9B are schematic diagrams for explaining an error between a check box and an actual pattern.
Figure 9B:
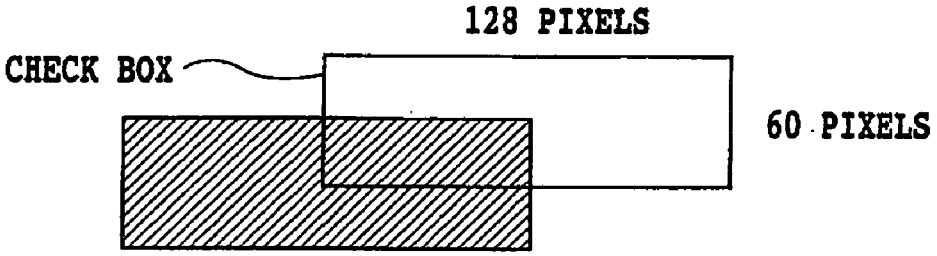

FIGS. 9A and 9B are schematic diagrams for explaining an error between a check box and an actual image pattern. In the state shown in FIG. 9A, a check box and a pattern having a high density are exactly superimposed with each other. In the state shown in FIG. 9B, a pattern having a high density is shifted from a check box in the main scanning direction at a distance equivalent to 64 pixels and in the sub-scanning direction at a distance equivalent to 30 pixels. This is the maximum error in this embodiment. In the actual image, various patterns are printed at various locations, while, for a check pattern employed for this embodiment, the arrangement relative to the printing medium is defined, and more or less the above described error can not help being included.

However, the error does not occur so long as a high density pattern is larger than a check box and is arranged so as to enclose the check box. Therefore, a small check box should be small, so that an error seldom occurs, and the area for which fixing takes time can be accurately detected. On the other hand, when a check box is set too small, the time cost would be reduced, e.g., a long detection period may be required, or a smear countermeasure may be required even for a text image that originally a smear does not become a problem. The appropriate size of a check box need be designated only in accordance with the use of an image to be printed, the properties of ink employed, the type of a printing medium, the scanning speed, the conveying speed and the width of a band. That is, the unit area 803 in FIG. 8 is formed of 128 pixels (main scanning direction)×60 pixels (sub-scanning direction); however, a unit area available for this embodiment is not limited to this size. Furthermore, by accumulating the detection results of the individual check boxes, the succeeding process may be determined.

Referring again to FIG. 7, at Step 3, a band marking routine is started. In this routine, the distance at which a printing medium has been conveyed from the start of printing is managed, the printing medium is divided, by one inch, into image segments in the conveying direction, and band numbers are provided for the obtained image segments.

Figure 10:
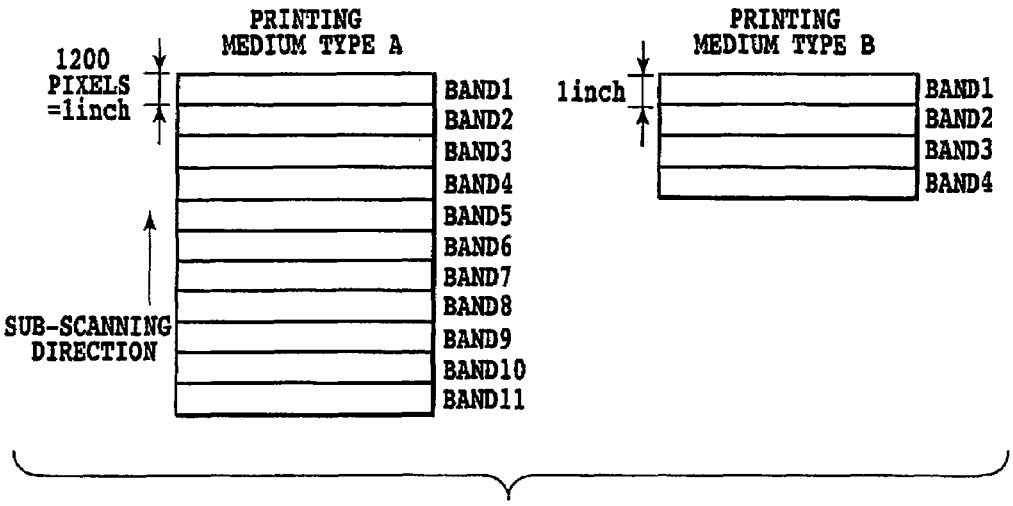
FIG. 10 is a schematic diagram for explaining an image area for which band numbers are provided.

FIG. 10 is a schematic diagram for explaining image areas for which the band numbers are provided at Step 3. In this embodiment, it is assumed that the printing heads 22 shown in FIG. 3 are employed to perform bidirectional printing. Therefore, the width of each band indicates an area printed by one main scanning, and is equal to 1200 nozzles (i.e., one inch). Counting of the conveying distance and providing a band number, which were started at Step 3, are continued until the trailing edge of the printing medium is detected by a paper end sensor. Through the above two routines, the printing ratio can be managed for each band. For the printing apparatus 240 in this embodiment, the maximum length of an available printing medium is regarded as eleven inches, and the memory for eleven bands is prepared in the printing apparatus 240. In FIG. 10, a printing medium type A having a length of eleven inches and a printing medium type B having a width of four inches are shown as examples. The printing medium A include band 1 to band 11, while the printing medium B include only band 1 to band 4.

Referring again to FIG. 7, at Step 4, a check is performed to determine whether a delay mode is designated for the succeeding printing scan (succeeding band). The delay mode is a mode in which a delay is added to the next printing scan, and is set when it is apprehensive about the occurrence of smear by the next printing scan. When it is determined at Step 4 that the delay mode is set, program control advances to Step 5, and printing consonant with the delay mode is performed. In this embodiment, the processing is waited during a predetermined period of time, and thereafter the normal printing scan and the conveying of a printing medium by one inch are performed. When it is determined at Step 4 that the delay mode is not set, program control is shifted to Step 6, and the normal printing scan and the conveying of a printing medium by one inch are performed.

At Step 7 to Step 11, the fixing period for the band printed at Step 5 or Step 6 is designated. First, at Step 7, the black printing ratio is examined for the individual unit areas (check boxes) of the band (target band) that is printed at Step 5 or Step 6. Specifically, a check is performed to determine whether a unit area that indicates a black printing ratio of equal to or greater than 50% (high duty area) is present in the target band. When it is determined that a high duty area is present, program control advances to Step 8 to manage the fixing period for the high duty area.

At Step 8, the number provided for the band, which includes the high duty area detected at Step 7, and the printing ratio are obtained, and information for that effect is stored in the memory prepared for this band.

Figure 11:
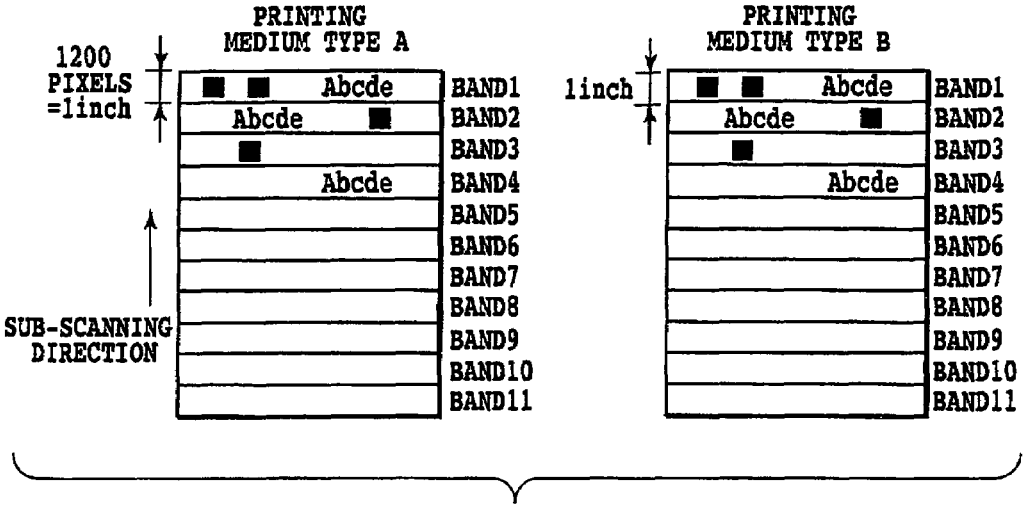
FIG. 11 is a diagram showing an example pattern present in each band.

FIG. 11 is a diagram showing an example image pattern printed in each band. In this embodiment, text (Abcde) shown in FIG. 11 is not detected as an area having a black printing ratio of equal to or great than 50%. Only rectangular solid black patterns are detected as areas having a black printing ratio of equal to or great than 50%. Based on high duty area information detected in this manner, management data for the individual bands are generated at Step 9.

At Step 9, based on the above described information, information (2), which indicates the current page is being printed, a band number (n) and the fixing period (two seconds or three seconds) of the pertinent band are stored as one set of three-dimension data (2, n, 2 or 3). For example, since band 5 for the current page is to be printed by the forward scanning, two seconds is set for the fixing period for band 5. In this case, data (2, 3, 2) are stored for band 5. The different fixing period is designated depending on whether the band is printed by the forward scanning or by the reverse scanning. In this embodiment, the forward scanning is "top black ejection" whereby color inks are applied prior to black ink, and two seconds is designated for the fixing period. Further, the reverse scanning is "bottom black ejection" whereby color inks are applied after black ink, and three seconds is designated for the fixing period.

At Step 10, a timer is reset and then started so as to decrement the fixing period set at Step 9 by every 0.1 seconds.

When it is determined at Step 7 that a unit area (high duty area) having a printing ratio equal to or greater than 50% is not present in the target band, program control advances to Step 11. At Step 11, three-dimension data (2, band number, 0) are defined, and 0 second is fixed and stored as the fixing period.

Sequentially, at Step 12 to Step 16, a check is performed to determine whether the printing operation for the printing medium that is currently printed can be continued, and also to determine whether the delay mode is designated for the succeeding printing operation. First, at Step 12, a check is performed to determine whether the preceding printing operation was performed for band 8 and the following. When it is determined that the preceding printing operation was for band 8 and the previous bands, in this embodiment, it is assumed that setting of the delay mode is not necessary, and program control jumps to Step 17 for the next printing scan. For the printing apparatus 240 for this embodiment, as explained while referring to FIG. 15, the sheet discharge port is located above the discharge tray, and a printing medium is discharged by being supported from beneath. Therefore, printing can be continued for a specific portion from the leading edge of a printing medium, without taking into account that the printing medium may contact a printing medium that has been already discharged. In this embodiment, assume that, when printing is performed up to nine inches from the leading edge, the leading edge of the printing medium is dropped down, and this printing medium may contact band 3 of a printing medium that is previously discharged. Therefore, for the current page, between band 1 and band 8, printing can be continued. When it is determined at Step 12 that the preceding printing operation was for band 8 and the following, program control advances to Step 13.

At Step 13, a check is performed to confirm whether ink of the previous page that is discharged is fixed so that smearing does not occur when the leading edge of a printing medium that is currently printed (current page) contacts the previous page. The contacting position of the previous page differs depending on the portion (band) currently printed. Therefore, the position for confirming the fixing state in the previous page is different in accordance with the number provided for the band that is currently printed. For example, when band 9 of the current page is printed, the leading edge of the current page may contact band 3 of the previous page. Therefore, the fixed state of band 3 of the previous page is examined. Furthermore, when band 10 of the current page is printed, the leading edge of the current page may contact band 2 of the previous page. Therefore, the fixed state of band 2 of the previous page is examined. In addition, when band 11 of the current page is printed, the leading edge of the current page may contact band 1 of the previous page. Thus, the fixed state of band 1 of the previous page is examined. Specifically, three dimension data of the previous page for each case are obtained.

In this embodiment, a memory is also prepared for storing three dimension data for a printing medium for one page that is discharged. For a page that is discharged, information (1) that indicates this page has been printed, an band number and the fixing period for each band are stored as one set of data. Of course, the fixing period is decremented, by 0.1 seconds, from the fixing time that was set when printing was actually band performed (Step 10).

At Step 14, a check is performed to determine whether the fixing period, obtained at Step 13, in the three dimension data for the previous page is equal to 0. When the fixing period is not 0, it is assumed that smearing may occur when printing is continued. Therefore, program control advances to Step 16, and the delay mode is set. The delay mode is a mode for halting printing for the next band at least until the fixing period reaches 0, i.e., a mode for entering a wait period before printing for the next band is started. According to this mode, since the current page does not contact the high duty area of the preceding page within the fixing period determined at Step 8, occurrence of smearing can be reduced. When the fixing period is 0, the previous page is already fixed, and it is assumed that smearing can be avoided. Thus, program control is shifted to Step 15, and the delay mode is reset.

In this embodiment, the delay mode that can be applied for this embodiment is not limited to the above method for providing a waiting period. The printing operation for the current page can be delayed by, for example, reducing the scanning speed of the printing head, reducing the speed of conveying the printing medium, or changing the timing for conveying the printing medium. Further, these delay control methods may be employed together. The delay mode applicable for this embodiment is a mode for delaying the printing operation while the current page is being printed, so that current page does not contact the high duty area of the previous page within a period (fixing period) extended until the current page Is permitted to contact the high duty area of the previous page.

At Step 17, a check is performed to determine whether the paper end sensor 123 detects the trailing edge of the printing medium that has been conveyed at Step 5 or Step 6. When It Is determined that the trailing edge Is not detected, program control returns to Step 4. and is shifted to printing for the next band. When it is determined that the trailing edge Is detected, program control advances to Step 18.

Step 18 to Step 21 are the discharging processes. First, at Step 18. a check is performed to determine whether the current printing medium for which printing is regarded as completed can be discharged. Specifically, the remaining fixing periods for all the bands 9 to 11 of the previous page that the current page may contact when it is discharged are examined. Since the leading edge of the current page might be rubbed against the band 8 and preceding bands of the previous page, examining of the remaining fixing period and the delay mode processing are already performed at Step 12 to Step 16. Therefore, the fixing period need not be confirmed again at Step 18. On the other hand, band 9 to band 11 are new areas where smearing would occur when the current page is discharged. Therefore, at Step 18, the remaining fixing periods for only bands 9 to 11 are examined.

When at least one of the remaining fixing periods for the bands 9 to 11 are not 0, the remaining fixing periods are examined again, and this process is repeated until the remaining fixing periods for all the bands are 0. When the remaining fixing periods for all the bands are 0, program control advances to Step 19, and the sheet discharging process is performed.

At Step 20, marking for the page is changed from "2", indicating currently printed to "1" indicating already discharged. At the same time, regardless of the length of a printing medium, the numbers of the individual bands are rewritten to the rear, with 11 being as a reference. For example, when a printing medium has a length of four inches like the printing medium type B shown in FIG. 10, bands 1 to 4 currently printed are changed to bands 8 to 11 after the printing medium is discharged. For the printing apparatus for this embodiment, the printing medium that are discharged are aligned along the trailing edges. Thus, in order to manage the number of the band that contacts the leading edge of a printing medium that is sequentially printed, the printing medium should be aligned with the trailing edges being as a reference, so that the management processing is easily performed.

At Step 21, a check is performed to determine whether the current job is ended. When it is determined that the current job is ended, the processing is terminated. When it is determined that the current job is not yet ended, program control returns to Step 1, and is shifted to printing for the next page.

As described above, according to this embodiment, the different fixing periods are designated for the high duty area printed by forward scanning and the high duty area printed by reverse scanning. And the printing delay process is performed during printing of the current printing medium, so that, within the thus designated fixing period, the current printing medium does not contact the high duty area of the preceding printing medium. Therefore, compared with the system wherein the delay mode is designated without considering the variance of the fixing period that is caused by the different ink application orders, a delay in printing for a succeeding printing medium can be shortened.

Second Embodiment

According to the first embodiment, based on the scanning direction (ink application order), a fixing period of two seconds or three seconds is uniformly designated for each unit area. However, strictly, the fixing period is affected by the printing ratio, the type of printing medium, or the temperature and humidity of the environment. Therefore, the fixing period can also be designated while taking these conditions in to account. As the characteristic of the second embodiment, the fixing period is determined not only based on the scanning direction (ink application order), but also in accordance with the printing ratio, the printing medium type and the environmental conditions, such as the temperature or the humidity. Since the configuration other than the characteristic portion is substantially the same as that for the first embodiment, no further explanation for this will be given.

When there are a plurality of compatible printing medium, large discrepancies may appear in fixing periods for these printing medium. For example, assume that compatible printing medium types can be regarded as printing medium types A and B in accordance with a difference in fixing periods. In this case, at Step 9 in FIG. 7, the fixing periods can be designated not only in accordance with "top black ejection" and "bottom black ejection", but also in accordance with "printing medium type A" and "printing medium type B". For example, for the "printing medium type A", as well as in the first embodiment, two seconds is designated for "top black ejection", and three seconds is designated for "bottom black ejection". For the "printing medium type B" that requires more time for fixing, different values from those for the "printing medium A" may be designated, i.e., 15 seconds is designated for "top black ejection", and 20 seconds is designated for "bottom black ejection".

Furthermore, a thermometer and a hygrometer may be provided to change the fixing period in accordance with the measured values. For example, at the normal ambient temperature and humidity, two seconds is designated for "top black ejection", and three seconds is designated for "bottom black ejection, as well as in the first embodiment. When the temperature and humidity equal to or higher than a predetermined threshold value are detected, 10 seconds for "top black ejection" and 15 seconds for "bottom black ejection" may be designated. Further, when a temperature and humidity equal to or lower than another threshold value are detected, a shorter fixing period can be designated, e.g., one second for "top black ejection" and two seconds for "bottom black ejection" can be designated.

In addition, in the first embodiment, the fixing period has been uniformly designated for the high duty area for which the black printing ratio exceeds 50%. However, strictly, the fixing period differs depending on the printing ratio N(%). Therefore, in the second embodiment, the fixing period is designated at multiple levels in accordance with the black printing ratio. In this case, at Step 9 in FIG. 7, different fixing periods can be designated in accordance with not only "top black ejection" and "bottom black ejection", but also "the printing ratio N(%) is $50 \leqq N < 60$", "the printing ratio N(%) is $60 \leqq N < 75$" and "the printing ratio N(%) is $N \geqq 75$". For example, when "the printing ratio N(%) is $50 \leqq N < 60$", as well as in the first embodiment, two seconds is designated for "top black ejection", and three seconds is designated for "bottom black ejection. When "the printing ratio N(%) is $60 \leqq N < 75$", six seconds is designated for "top black ejection", and seven seconds is designated for "bottom black ejection. When " the printing ratio N(%) is $N \geqq 75$", ten seconds is designated for "top black ejection", and eleven seconds is designated for "bottom black ejection.

There is a case wherein a plurality of high duty unit area is present in a single band, and a printing ratio differs in a plurality of portions. In this case, the fixing periods differ in these portions in the band. In this example, a plurality of fixing periods calculated for the plurality of portions in the single band, the longest fixing period is defined as the fixing period for this band. For example, there are two high duty areas in band 1 in FIG. 11, and the printing ration N(%) in one area is 50%, while the printing ratio N(%) in the other area is 75%. Then, the fixing period in the first area is calculated as two seconds, and the fixing period in the second area is calculated as ten seconds. In such a case, the fixing period for band 1 is designated as ten seconds.

As described above, according to the second embodiment, the fixing period is determined based on not only the scanning direction, but also the printing ratio, the printing medium type and the environmental condition, such as the temperature and the humidity. Therefore, compared with in the first embodiment, a shorter fixing period can be designated.

Third Embodiment

In the first and the second embodiments, the color ink application data 5020 in FIG. 16 used for smear countermeasure has been generated. In a third embodiment, color ink application data 5020 are not generated. That is, the process in which color ink for smear countermeasure is applied to a high duty black image area is not performed. This is because there are many cases wherein, even without performing such a process, color ink is ejected to high duty black image area. For example, when a color image area is present around a black image area, there is a high probability that color ink is applied to the black image area, because of the image processing, such as error dispersion.

In this embodiment, for a high duty area for which the black printing ratio is beyond 50%, the fixing period is set in accordance with a color printing ratio. In this case, at Step 9 in FIG. 7, different fixing periods are designated at a plurality of levels not only based on "top black ejection" and "bottom black ejection", but also in accordance with a color printing ratio M(%). In this case, first, the color printing ratio for the unit area is detected based on CMY binary data (the original CMY data 5001, 5002 and 5003 in FIG. 16) stored in the print buffer 229. Following this, a check is performed to determine the range the detected color printing ratio M(%) belongs to, $0 \leqq M < 12.5$, $12.5 \leqq M < 25$ or $25 \geqq M$. Finally, the fixing period is designated while taking into account the range the color printing ratio M(%) belongs to, and "top black ejection" or "bottom black ejection". For example, when "the color printing ratio M(%) is $0 \leqq M < 12.5$", four seconds is designated for "top black ejection", and five seconds is designated for "bottom black ejection". When "the color printing ratio M(%) is 12.5≦M<25", as well as in the first embodiment, two 10 seconds is designated for "top black ejection", and three seconds is designated for "bottom black ejection". When "the color printing ratio M(%) is 25≧M", one second is designated for "top black ejection", and two seconds is designated for "bottom black ejection".

As described above, according to the third embodiment, the process in which color ink for smear attenuation is applied to a high duty black image area shown in FIG. 16 is not performed, and with a simple arrangement, a comparatively short fixing period can be designated.

Other Embodiment

In the above embodiments, pigment black ink and dye color ink that reacts to the black ink have been employed together as an example. The effect of the present invention is acquired not only by this combination of ink. Inks that react to each other are not necessarily employed, and the color material types may be a pigment or a dye. For example, pigment ink may be employed both for black and color inks, or dye ink may be employed both for black and color inks. So long as a system employs a set of ink by which the fixing period tends to be varied depending on different scanning directions (ink application orders), the effects of the present invention can be provided. A specific example for such a set of ink can be a set of ink having different permeance properties (e.g., the Ka values or the surface tensions) as explained in the first embodiment. Since the compositions of ink differ as the ink types differ, more or less, the fixing period varies depending on different ink application orders. Therefore, the present invention can be applied for a system that employs different ink types (first ink and second ink), and performs printing on a printing medium wherein there are both a unit area to be printed in the order of the first ink and the second ink and a unit area to be printed in the order of the second ink and the first ink.

Furthermore, for the printing apparatus of the present invention, a plurality of types of printing head cartridges that have different ink types and discharge different amounts of ink may be replaceable relative to the printing apparatus. In this case, it is preferable that, each time the printing head cartridge is replaced, the setup value of the fixing period be changed. This specification can be provided by, for example, automatically reading the ID number provided for a printing head cartridge that is mounted, and by reading, from the memory of the printing apparatus or a host, a setup value consonant with the ID number.

Further, in the above embodiments, an explanation has been given for one-path printing, i.e., the example wherein an image to be printed in the same area of a printing medium is completed by one scan of the printing head. The present invention is not limited to this. The present invention can also be applied for multi-path printing whereby an image to be printed in the same area of a printing medium is completed by a plurality of scans of the printing head.

In addition, instead of employing the concept of the unit area, an object in a printed image may be employed to calculate the printing ratio, and the fixing period may be designated for each object. In this case, it is efficient that the calculation of the printing ratio of each object and the marking process are performed by the printer driver of the host that is an image providing source, and that fixing period information is transmitted to the printing apparatus through the interface. It should be noted, however, that, since one object may be formed by a plurality of scans, the fixing period for the object is determined, while taking into account the fixing period designated for forward scanning and the fixing period designated for reverse scanning.

In the above embodiments, the process sequence explained in FIG. 7 has been regarded as performed by the MPU in the printing apparatus. However, the present invention is not limited to this arrangement. For example, all of, or one part of the processing may be performed by the host (data supply apparatus) externally connected to the printing apparatus. This arrangement is also included in the inkjet printing system for the present invention.

According to the present invention, printing for a current printing medium (succeeding printing medium) is delayed, while taking into account the amount of applied ink and the ink application order for the unit area of a printing medium (previous printing medium) that is already discharged. When there is a probability that the current printing medium contacts the high duty area of the previous printing medium, the delay in printing of the current printing medium can be minimized. As a result, an image from which smearing is prevented can be output, without the printing speed being deteriorated more than necessarily.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

This application claims priority from Japanese Patent Application No. 2005-171527 filed Jun. 10, 2005, which is hereby incorporated by reference herein.

What is claimed is:

1. An inkjet printing apparatus, which prints on a printing medium by reciprocally moving, across the printing medium, printing heads that at least apply a first ink and a second ink of a type different from that of the first ink, comprising:

a print controller which performs printing so that a unit area to which the first ink and the second ink are applied in this order and a unit area to which the second ink and the first ink are applied in this order are both present on the printing medium, wherein, based on an amount of ink applied and an ink application order for unit areas of a preceding printing medium, the print controller delays printing during the printing of a following printing medium.

2. An inkjet printing apparatus according to claim 1, wherein the print controller includes:

a determination unit which, based on the amount of ink applied and the ink application order for at least one of the unit areas of the preceding printing medium, determines a period of time during which the following printing medium is not permitted to contact the at least one unit area of the preceding printing medium; and a delay controller, which delays the printing of the following printing medium, currently being printed, so that the following printing medium does not contact the unit areas of the preceding printing medium during the determined period of time.

3. An inkjet printing apparatus according to claim 2, wherein the amount of ink applied that the determination unit employs as a parameter for determining the period of time is an amount of the first ink applied.

4. An inkjet printing apparatus according to claim 2, wherein the amount of applied ink that the determination unit employs as a parameter for determining the period includes an amount of the first ink applied and an amount of the second ink applied.

5. An inkjet printing apparatus according to claim 1, wherein the print controller includes:

a detection unit, which calculates an amount of ink applied for each of a plurality of unit areas that are obtained by dividing the preceding printing medium, and which detects a unit area for which the amount of ink applied exceeds a predetermined amount;

a determination unit which, based on an ink application order for the detected unit area, detects a period of time during which the following printing medium is not permitted to contact the detected unit area of the preceding printing medium; and a delay controller which delays the printing of the following printing medium, currently being printed, so that the following printing medium does not contact the detected unit area of the preceding printing medium during the determined period of time.

6. An inkjet printing apparatus according to claim 5, wherein the delay controller includes:

decrementing means for decrementing the determined period of time as time elapses; and confirmation means for examining the period of time decremented by the decrementing means to determine whether the period of time has been reduced to 0, wherein the printing is delayed each time the confirmation means determines that the period of time being decremented has not been reduced to 0.

7. An inkjet printing apparatus according to claim 5, wherein the detection unit calculates the amount of ink applied by determining how often ink has been applied to the unit area.

8. An inkjet printing apparatus according to claim 7, wherein the detection unit detects a unit area for which the amount of the first ink applied exceeds the predetermined amount.

9. An inkjet printing apparatus according to claim 5, wherein the determination unit determines the period of time based on at least one condition selected from among a printing medium type, an environmental temperature and an environmental humidity.

10. An inkjet printing apparatus according to claim 1, wherein the print controller delays the printing operation by performing at least one of temporary halting of printing of the following printing medium, changing of a scanning speed of the printing heads, changing of a speed for conveying the printing medium, and changing of a timing for conveying the printing medium.

11. An inkjet printing apparatus according to claim 1, wherein the first ink has a different surface tension than that of the second ink.

12. An inkjet printing apparatus according to claim 11, wherein the surface tension of the first ink is greater than the surface tension of the second ink.

13. An inkjet printing apparatus according to claim 1, wherein the first ink has a different Ka value than that of the second ink.

14. An inkjet printing apparatus according to claim 13, wherein the Ka value of the first ink is smaller than the Ka value of the second ink.

15. An inkjet printing apparatus according to claim 1, wherein the first ink is black ink, and the second ink is color ink, and wherein black ink has a different permeating property than that of the color ink.

16. An inkjet printing apparatus according to claim 15, wherein the color ink contains a component that coagulates a component contained in the black ink.

17. An inkjet printing apparatus, which prints on a printing medium by reciprocally moving, across the printing medium, printing heads that apply at least a first ink and a second ink having a higher permeating speed than that of the first ink, comprising:

a print controller which performs printing so that a unit area to which the first ink and the second ink are applied in this order, and a unit area to which the second ink and the first ink are applied in this order are both present on the printing medium, wherein, based on an applied amount of the first ink and an order of application of the first ink and the second ink relative to unit areas of a preceding printing medium, the print controller delays printing during the printing operation of a following printing medium.

18. An inkjet printing apparatus, which prints on a printing medium by reciprocally moving, across the printing medium, printing heads that apply at least a first ink and second ink having a higher permeating speed than that of the first ink, comprising:

a print controller which performs printing so that a unit area to which the first ink and the second ink are applied in this order, and a unit area to which the second ink and the first ink are applied in this order are both present on the printing medium, wherein, based on applied amounts of the first ink and the second ink and an order of application of the first ink and the second ink relative to unit areas of a preceding printing medium, the print controller delays printing during the printing operation of a following printing medium.

19. An inkjet printing apparatus, which prints on a printing medium by reciprocally moving printing heads that apply a plurality of ink types, comprising:

detection means for calculating an amount of applied ink for each of a plurality of unit areas that are obtained by dividing a preceding printing medium that is printed first, and for detecting a unit area for which the amount of applied ink is beyond a predetermined amount;

determination means for, based on a scanning direction in which the detected area is to be printed, determining a period of time until a following printing medium, which is to be printed next, is permitted to contact the detected unit area; and delay control means for delaying printing while the following printing medium is currently printed, so that, within the determined period, the following printing medium does not contact the detected unit area of the preceding printing medium.

20. An inkjet printing method, for printing on a printing medium by reciprocally moving, across the printing medium, printing heads that at least apply a first ink and a second ink of a type different from that of the first ink, comprising:

performing printing so that a unit area to which the first ink and the second ink are applied in this order and a unit area to which the second ink and the first ink are applied in this order are both present on the printing medium, wherein, based on an amount of ink applied and an ink application order for unit areas of a preceding printing medium, the printing is delayed during the printing of a following printing medium.

21. An inkjet printing system comprising an inkjet printing apparatus and a data supply apparatus connected to the inkjet printing apparatus , wherein the inkjet printing apparatus prints on a printing medium by reciprocally moving, across the printing medium, printing heads that at least apply a first ink and a second ink of a type different from that of the first ink, comprising:

a print controller which performs printing so that a unit area to which the first ink and the second ink are applied in this order and a unit area to which the second ink and the first ink are applied in this order are both present on the printing medium, wherein, based on an amount of ink applied and an ink application order for unit areas of a preceding printing medium, the print controller delays printing during the printing of a following printing medium.

* * * * *

UNITED STATES PATENT AND TRADEMARK OFFICE

CERTIFICATE OF CORRECTION

PATENT NO. : 7,367,643 B2
APPLICATION NO. : 11/448785
DATED : May 6, 2008
INVENTOR(S) : Tomomi Furuichi et al.

It is certified that error appears in the above-identified patent and that said Letters Patent is hereby corrected as shown below:

COLUMN 1:
Line 58, “above described” should read -- above-described --.

COLUMN 2:
Line 43, “discharged.” should read -- discharged, --.

COLUMN 3:
Line 2, “images” should read -- image --.
Line 3, “above described” should read -- above-described --.
Line 4, “in” should read -- to --.
Line 16, “is” should read -- are --.

COLUMN 4:
Line 31, “printingmedium,” should read -- printing medium, --.

COLUMN 5:
Line 42, ““sprinting”” should read -- “printing” --.
Line 54, “above described” should read -- above-described --.

COLUMN 7:
Line 51, “well known” should read -- well-known --.
Line 66, “well known” should read -- well-known --.

COLUMN 11:
Line 57, “well known” should read -- well-known --.

COLUMN 12:
Line 23, “is” should be deleted.
Line 35, “above described” should read -- above-described --.

UNITED STATES PATENT AND TRADEMARK OFFICE

CERTIFICATE OF CORRECTION

PATENT NO. : 7,367,643 B2
APPLICATION NO. : 11/448785
DATED : May 6, 2008
INVENTOR(S) : Tomomi Furuichi et al.

It is certified that error appears in the above-identified patent and that said Letters Patent is hereby corrected as shown below:

COLUMN 14:

Line 2, “pseudo random” should read -- pseudo-random --.
Line 5, “above described” should read -- above-described --.
Line 59, “above described” should read -- above-described --.

COLUMN 15:

Line 20, “can not” should read -- cannot --.
Line 28, “can not” should read -- cannot --.

COLUMN 17:

Line 21, “above described” should read -- above-described --; and “can not” should read -- cannot --.
Line 66, “include” should read -- includes --.
Line 67, “include” should read -- includes --.

COLUMN 18:

Line 33, “great” should read -- greater --.
Line 35, “great” should read -- greater --.
Line 38, “above described” should read -- above-described --.
Line 42, “three-dimension” should read -- three-dimensional --.
Line 60, “three-dimension” should read -- three-dimensional --.
Line 61, “second” should read -- seconds --.

COLUMN 19:

Line 45, “three-dimension” should read -- three-dimensional --.
Line 47, “an” should read -- a --.
Line 53, “three dimension” should read -- three-dimensional --.

UNITED STATES PATENT AND TRADEMARK OFFICE

CERTIFICATE OF CORRECTION

PATENT NO. : 7,367,643 B2
APPLICATION NO. : 11/448785
DATED : May 6, 2008
INVENTOR(S) : Tomomi Furuichi et al.

It is certified that error appears in the above-identified patent and that said Letters Patent is hereby corrected as shown below:

COLUMN 20:

Line 18, both occurrences of "Is" should read -- is --.
Line 19, "Step 4." should read -- Step 4, --.
Line 23, "Step 18." should read -- Step 18, --.
Line 61, "is ended." should read -- has ended. --.
Line 62, "is ended," should read -- has ended, --.
Line 63, "is not yet ended," should read -- has not yet ended, --.

COLUMN 21:

Line 20, "in to" should read -- into --.
Line 52, "ejection," should read -- ejection", --.

COLUMN 22:

Line 13, "ejection." should read -- ejection". --.

Signed and Sealed this

Seventeenth Day of March, 2009

JOHN DOLL
*Acting Director of the United States Patent and Trademark Office*